US012790820B2

(12) United States Patent
Yigit et al.

(10) Patent No.: US 12,790,820 B2
(45) Date of Patent: Nov. 10, 2026

(54) STRUCTURAL BLOCK SYSTEMS, ROOF MEMBRANE SYSTEMS, COMPOSITE STRUCTURAL BOARDS, FLOOR AND DECK SYSTEMS, AND RELATED METHODS

(71) Applicant: Mehmet Yigit, Sturgeon County (CA)

(72) Inventors: Mehmet Yigit, Sturgeon County (CA); Timur Yigit, Sturgeon County (CA)

(73) Assignee: Mehmet Yigit, Sturgeon County (CA)

( * ) Notice: Subject to any disclaimer, the term of this patent is extended or adjusted under 35 U.S.C. 154(b) by 0 days.

(21) Appl. No.: 18/091,835

(22) Filed: Dec. 30, 2022

(65) Prior Publication Data

US 2024/0218659 A1 Jul. 4, 2024

(51) Int. Cl.

| | |
|---|---|
| ***E04B 2/52*** | (2006.01) |
| ***E04B 2/26*** | (2006.01) |
| ***E04B 2/58*** | (2006.01) |
| ***E04C 1/41*** | (2006.01) |
| *E04B 2/02* | (2006.01) |
| *E04C 1/40* | (2006.01) |

(52) U.S. Cl.

CPC ..... *E04B 2/52* (2013.01); *E04B 2/26* (2013.01); *E04B 2/58* (2013.01); *E04C 1/41* (2013.01); *E04B 2002/0243* (2013.01); *E04B 2002/0286* (2013.01); *E04B 2002/0293* (2013.01); *E04B 2103/02* (2013.01); *E04C 1/40* (2013.01)

(58) Field of Classification Search

CPC ..... E04B 2/26; E04B 2/52; E04B 2002/0243; E04B 2002/0286; E04B 2002/0293; E04C 1/40; E04C 1/41

See application file for complete search history.

(56) References Cited

U.S. PATENT DOCUMENTS

| | | | | | |
|---|---|---|---|---|---|
| 2,106,177 | A * | 1/1938 | Hultquist | E04B 2/52 | 52/308 |
| 2,929,238 | A * | 3/1960 | Kaye | E04B 2/48 | 52/690 |
| 3,479,782 | A * | 11/1969 | Muse | E04B 2/26 | 52/438 |
| 3,546,833 | A * | 12/1970 | Perreton | E04B 2/46 | D25/115 |
| 3,609,926 | A * | 10/1971 | Muse | E04B 2/44 | 52/439 |

(Continued)

FOREIGN PATENT DOCUMENTS

| | | | |
|---|---|---|---|
| AU | 2020103969 | | 2/2021 |
| CN | 1657482 | A * | 8/2005 |

(Continued)

OTHER PUBLICATIONS

Matt Greenfield, 4 Benefits of Fiber Cement Decking, obtained Dec. 5, 2022, 7 pages.

(Continued)

*Primary Examiner* — Jessie T Fonseca
(74) *Attorney, Agent, or Firm* — Robert A. Nissen

(57) ABSTRACT

A composite structural board has a wood board core; an internal mesh layer encasing the wood board core; and an external resilient cement coating. A driveway system has a cement base layer embedded with a plasticizing layer that comprises polymeric material; a stone panel layer, comprising a plurality of stone panels laid side-by-side; and an external overlayer.

20 Claims, 5 Drawing Sheets

(56) References Cited

U.S. PATENT DOCUMENTS

| | | | | | |
|---|---|---|---|---|---|
| 3,780,484 | A * | 12/1973 | Muse | E04B 2/46 | 52/568 |
| 4,016,693 | A * | 4/1977 | Warren | E04C 1/41 | 52/605 |
| 4,034,529 | A * | 7/1977 | Lampus | E04B 1/4185 | 52/690 |
| 4,694,624 | A * | 9/1987 | Juhas | E04C 1/397 | 52/270 |
| 5,066,440 | A * | 11/1991 | Kennedy | E04B 2/24 | 264/246 |
| 5,596,855 | A * | 1/1997 | Batch | E04C 1/40 | 52/309.11 |
| 5,729,942 | A * | 3/1998 | Moore, Jr. | E04C 1/40 | 52/211 |
| 7,762,033 | B2 * | 7/2010 | Scott | E04B 2/06 | 52/432 |
| 10,544,583 | B2 * | 1/2020 | Muirhead | E04B 2/34 | |
| 10,563,397 | B2 * | 2/2020 | Van Cauter | E04C 1/40 | |
| 11,459,750 | B1 * | 10/2022 | Manesh | E04C 1/41 | |
| 2005/0257466 | A1 * | 11/2005 | Tabeshnekoo | E04B 2/16 | 52/314 |
| 2006/0101756 | A1 * | 5/2006 | McClure | E04C 1/41 | 52/405.1 |
| 2008/0104916 | A1 * | 5/2008 | Schmid | E04C 1/41 | 52/745.19 |
| 2011/0258957 | A1 * | 10/2011 | Virnich | E04B 2/42 | 52/562 |
| 2014/0053493 | A1 * | 2/2014 | Carey | E04C 1/40 | 52/604 |
| 2016/0145864 | A1 * | 5/2016 | Al-Salloum | E04B 2/44 | 52/600 |
| 2021/0115668 | A1 * | 4/2021 | Lee | C04B 28/30 | |

FOREIGN PATENT DOCUMENTS

| | | | | |
|---|---|---|---|---|
| CN | 103912094 | | 7/2014 | |
| CN | 104563379 | | 4/2015 | |
| CN | 108264262 | | 7/2018 | |
| CN | 208830583 | U * | 5/2019 | E04C 1/40 |
| CN | 112814266 | | 5/2021 | |
| CN | 113119280 | | 7/2021 | |
| DE | 3416321 | | 11/1985 | |
| KR | 101900038 | | 9/2018 | |
| KR | 102207048 | | 1/2021 | |
| RU | 2634136 | | 10/2017 | |
| WO | 2012093981 | | 7/2012 | |
| WO | 2019221617 | | 11/2019 | |
| WO | 2020204569 | | 10/2020 | |

OTHER PUBLICATIONS

Moistureshield, Wood Vs. Composite Decking: Let's Compare, published Sep. 14, 2019, 12 pages.

Trex, Trex vs. Plastic Decking, obtained Dec. 5, 2022, 21 pages.

Builddirect, Different Types of Composite Decking: Hollow vs Solid Core Boards, obtained Dec. 5, 2022, 4 pages.

Murrye Bernard, Plastic Wood Deck Lumber: What to Know Before You Buy, Oct. 7, 2022, 10 pages.

* cited by examiner

Fig. 18
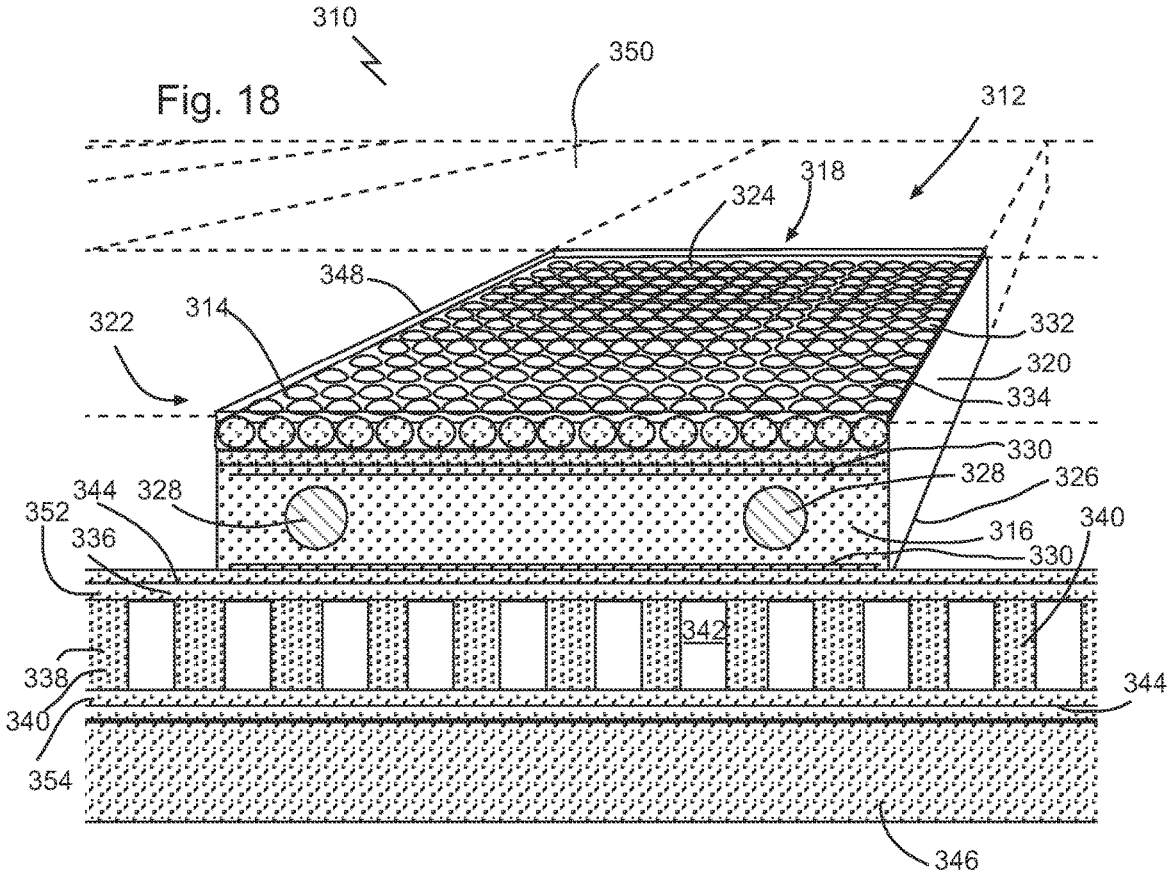
Fig. 19
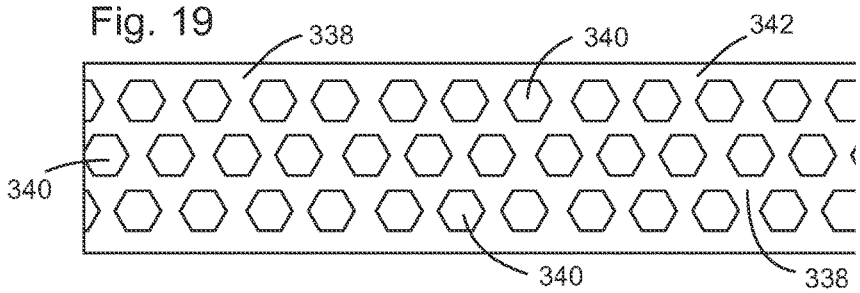
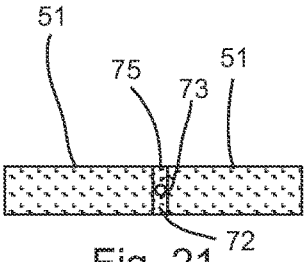
Fig. 21
Fig. 20
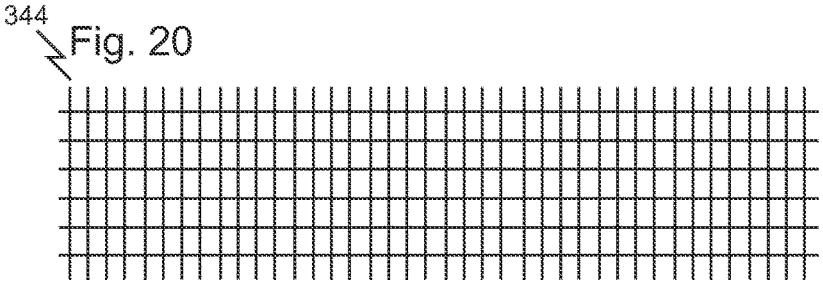

STRUCTURAL BLOCK SYSTEMS, ROOF MEMBRANE SYSTEMS, COMPOSITE STRUCTURAL BOARDS, FLOOR AND DECK SYSTEMS, AND RELATED METHODS

TECHNICAL FIELD

This document relates to structural block systems, roof membrane systems, composite structural boards, floor and deck systems, and related methods.

BACKGROUND

The following paragraphs are not an admission that anything discussed in them is prior art or part of the knowledge of persons skilled in the art.

Hollow block systems are known where cement is poured through aligned cavities in layers of blocks.

Roof, deck, and balcony membranes are known that have a water impervious layer glued to a substrate.

Plastic wood or plastic boards are used as a relatively higher-priced, relatively longer-lasting alternative to traditional wood in the construction of deck systems. Plastic wood boards include a matrix of plastic and wood grains adhered together, and are prone to rotting and other structural damage over time.

Driveway and flooring systems incorporate networks of stone panels laid side-by-side, and layers of concrete, and are prone to cracking and development of fissures therein.

SUMMARY

The foregoing summary is not intended to summarize each potential embodiment or every aspect of the subject matter of the present disclosure. These and other aspects of the device and method are set out in the claims.

A structural system is disclosed comprising: a plurality of blocks arranged in rows stacked on each other, with the blocks of each row staggered relative to the blocks of adjacent rows, each block having a foam core, and external coating plates cladding opposed inside and outside faces of the block between opposed side ends of the block; and a plurality of cement columns extended through adjacent rows of the plurality of blocks via aligned columnar apertures defined within the foam cores of each block.

A method is disclosed comprising: arranging a plurality of blocks in rows stacked on each other, with the blocks of each row staggered relative to the blocks of adjacent rows, each block having a foam core, and external coating plates cladding opposed inside and outside faces of the block between opposed side ends of the block; and pouring cement through adjacent rows of the plurality of blocks via aligned columnar apertures defined within the foam cores of each block.

A structural block is disclosed comprising: a foam core; and external coating plates cladding opposed inside and outside faces of the block between opposed side ends of the block; and a series of columnar apertures, extended between and arranged in regular intervals along, top and bottom faces of the structural block, such that the columnar apertures align in use with corresponding columnar apertures of respective structural blocks that are identical with the structural block when such other respective structural blocks are laid above and below the structural block in staggered conformation.

A building membrane system is disclosed comprising: a plurality of membrane layers, each being flexible and waterproof; and a plurality of insulative panel layers; in which the building membrane covers a substrate of a building, and the plurality of insulative panel layers and plurality of membrane layers are stacked in alternating fashion.

A method is disclosed of forming a building membrane system comprising adhering a plurality of membrane layers and a plurality of insulative panel layers stacked together in alternating fashion over a substrate of a building, with each of the plurality of membrane layers being flexible and waterproof.

A building membrane is disclosed comprising: a base layer; an intermediate layer; and a top layer; in which each of the base layer, intermediate layer, and top layer comprise: acrylic polymer; sand or silica; and reinforcing mesh or fibers.

A composite structural board is disclosed comprising: a wood board core; an internal mesh layer encasing the wood board core; and an external resilient cement coating.

A method is also disclosed comprising: encasing a wood board core with a mesh layer; and molding an external resilient cement coating around the wood board core with mesh layer, to form a composite structural board.

A floor system is also disclosed comprising: a cement base layer embedded with a plasticizing layer that comprises polymeric material; a stone panel layer, comprising a plurality of stone panels laid side-by-side; and an external overlayer.

A method is also disclosed comprising: laying a cement base layer on a ground surface; adhering a stone panel layer on the cement base layer; and applying an external overlayer on the stone panel layer.

In various embodiments, there may be included any one or more of the following features: A plurality of structural beams extended through or between rows of the plurality of blocks. The plurality of structural beams are extended at an interface between adjacent rows of blocks via aligned beam slots defined within one or both of top and bottom faces of the blocks. The aligned beam slots are defined within both of top and bottom faces of the blocks. The aligned beam slots communicate with the aligned columnar apertures such that the plurality of cement columns and the plurality of structural beams integrally connect to form a structural matrix. The plurality of structural beams comprise rebar. The plurality of structural beams comprise cement beams. The plurality of cement columns comprise rebar. The structural system forms a wall; and the rebar of the plurality of cement columns secures to one or both a roof and floor above and below the wall, respectively. Each foam core comprises insulative expanded polymeric foam. Each foam core comprises expanded polystyrene. Each foam core is cut or molded to shape. The external coating plates comprise Sorel cement. The external coating plates comprise magnesium chloride and magnesium oxide. The external coating plates comprise: fly ash; sand; and perlite. The external coating plates are secured to the blocks via an adhesive. The adhesive comprises Sorel cement. The external coating plates are embedded with one or more of rebar columns and reinforcing mesh. The cement columns comprise Sorel cement. The cement columns comprise magnesium chloride and magnesium oxide. The cement columns comprise: fly ash; silica fume; reinforcing fibers; and sand; and are made with acrylic emulsion. Forming the structural system. Laying rebar beams through or between rows of the plurality of blocks. Before pouring, extending rebar through adjacent rows of the plurality of blocks via the aligned columnar apertures. In which the plurality of blocks form a wall; and further comprising securing the rebar of the plurality of cement columns to one or both a roof and floor above and below the wall, respectively. Forming each block by adhering the external coating plates to the foam core. Forming each foam core by one or more of cutting and molding the foam core. The plurality of membrane layers comprises an acrylic polymer. The plurality of membrane layers comprises: sand; silica fume; and cement. The plurality of membrane layers comprises one or both of reinforcing mesh and fiber. Forming a roof, deck, or balcony, of a building. The plurality of membrane layers comprise: a base membrane layer; an intermediate membrane layer; and a top membrane layer. The substrate of the building comprises: a board surface; and a vapor barrier above or below the board surface. A base membrane layer of the plurality of membrane layers is stacked above one of the plurality of insulative panel layers. One or more of the plurality of membrane layers extend up and over a parapet of the building. Layers of the plurality of membrane layers and the plurality of insulative panel layers are adhered together or to the substrate by an adhesive. The adhesive comprises a hydrophobic adhesive. The adhesive is made with: cement; perlite; and calcium hydroxide. A top membrane layer of the plurality of membrane layers comprises a protective outer coating. The protective outer coating is waterproof and comprises one or more of: an ultraviolet protector; a surface hardener; and a fire retardant. The protective outer coating comprises: styrene-acrylic polymer; titanium dioxide; silica fume; and perlite. The plurality of insulative panel layers comprise polystyrene. Membrane layers of the plurality of membrane layers each comprise: a base layer; an intermediate layer; and a top layer. The base layer comprises: styrene-acrylic polymer; silica fume; reinforcing mesh; and sand. The intermediate layer comprises: acrylic polymer; cement; sand; and reinforcing mesh or fibers. The top layer comprises: acrylic polymer; cement; silica flour; reinforcing mesh or fibers; and a decorative top surface finish. Membrane layers of the plurality of membrane layers each comprise: an insulative membrane panel; and membranes adhered to opposed faces of the insulative membrane panel, with each membrane comprising: styrene-acrylic polymer; silica fume or magnesium oxide; and reinforcing mesh or fibers. Moisture or temperature sensors in or between layers of the building membrane. Forming the building membrane system. An initial stage of securing a vapor barrier and board surface on the substrate. Forming further comprises extending membrane layers of the plurality of membrane layers up and over a parapet of the building. The composite structural board formed into a deck board. The external resilient cement coating is molded around the wood board core and the internal mesh layer. The internal mesh layer comprises fiberglass mesh. The internal mesh layer is secured to the wood board core by staples or fasteners. The wood board core comprises a plurality of wood beams secured together by an adhesive. The adhesive comprises a hydrophobic wood adhesive. The adhesive comprises a styrene-acrylic polymer. The adhesive comprises fly ash and sand. The wood board core comprises a hydrophobic pre-treatment seal coating. The external resilient cement coating is made with Portland cement and a plasticizer. The plasticizer comprises a superplasticizer; and the external resilient cement coating is made with: an acrylic emulsion; silica fume; and sand. The external resilient cement coating is made with reinforcing fibers. The external resilient cement coating comprises a fiberglass mesh layer. The composite structural board structured to elastically deform one inch or more per eight feet of length. A method comprising forming the composite structural board. Molding comprises: pouring a resilient cement pre-cursor slurry into a board mold to form a base layer in the board mold; inserting the wood board core with mesh layer onto the base layer in the board mold; and adding more resilient cement pre-cursor slurry to the mold to immerse the wood board core with mesh layer. Before molding, forming a resilient cement pre-cursor slurry by mixing: Portland cement; a plasticizer; an acrylic emulsion; silica fume; and sand. Before encasing, forming the wood board core by adhering plural wood beams together using an adhesive. The adhesive is formed by mixing: a styrene-acrylic polymer; fly ash; and sand. The composite structural board of is formed into a deck board. The floor system forming a driveway. The cement base layer is made with Portland cement and a plasticizer. For the cement base layer: the plasticizer comprises a superplasticizer; and the cement base layer is made with: fly ash; silica fume; and sand. The cement base layer is embedded with one or more wire mesh layers. The one or more wire mesh layers comprise a lower mesh layer and an upper mesh layer; and the plasticizing layer is disposed between the lower mesh layer and the upper mesh layer. The plasticizing layer forms a foam board that is structured as a mesh to define passages impregnated with cement from the cement base layer. The plasticizing layer defines a network of vertical passages, each defining a polygonal cross-sectional profile. Each stone panel is made with Portland cement and a plasticizer. For each stone: the plasticizer comprises a superplasticizer; and each stone panel is made with: perlite; silica fume; and sand. Each stone panel comprises one or more rebar rods. Each stone panel comprises one or more mesh reinforcing layers. Each stone panel comprises upper and lower fiberglass mesh layers as the one or more reinforcing layers. The stone panel layer is secured to the cement base layer by an adhesive. The adhesive comprises: Portland cement; an acrylic emulsion; and sand. The external overlayer comprises one or more of an epoxy layer, and a cement layer. The stone panels are adhered together via a grout. A gravel underlayer supporting the cement base layer. Forming the floor system. Laying the cement base layer comprises: laying a lower layer of cement embedded with a wire mesh layer; laying the plasticizing layer, which has a network of hollow column passages; and laying an upper layer of cement to immerse the plasticizing layer and impregnate the hollow column passages.

BRIEF DESCRIPTION OF THE FIGURES

Embodiments will now be described with reference to the figures, in which like reference characters denote like elements, by way of example, and in which:

FIG. 18 is a perspective view of a section (solid lines) of a driveway or other flooring system (dashed lines).

FIG. 19 is a top plan view of a foam board mesh used in the system of FIG. 8.

FIG. 20 is a top plan view of a wire mesh used in the system of FIG. 8.

FIG. 21 is a cross-sectional view of a grout line spacing between adjacent tiles, containing a backer rod.

DETAILED DESCRIPTION

Figure 1:
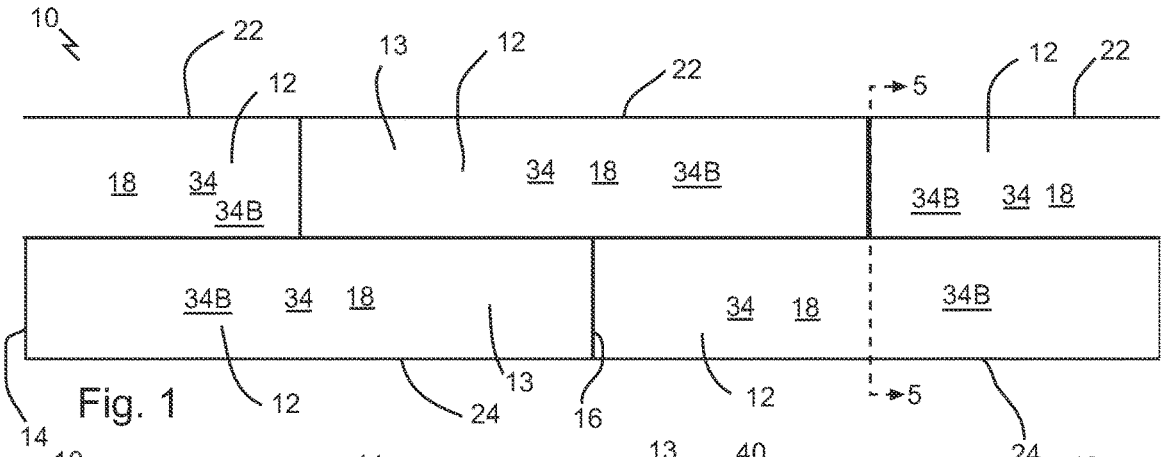
FIG. 1 is a side elevation view of a structural system comprising a plurality of blocks arranged in rows, with each row staggered relative to each other.

Immaterial modifications may be made to the embodiments described here without departing from what is covered by the claims.

Structural Block Systems

Buildings and walls may be made with bricks or other types of structural blocks. Typically, rows of bricks are laid on top of one another to build up a structure such as a brick wall or building. Bricks are a versatile building material, able to be used in a wide variety of applications, including structural walls, bearing and non-bearing sound proof partitions, fireproofing of structural-steel members in the form of firewalls, foundations for stucco, chimneys and fireplaces, porches and terraces, and brick walkways. Bricks are typically bonded to one another using mortar, and are laid in various patterns which may allow the bricks to form load bearing and non-load bearing walls. The mortar is the weaker component in brick walls, and may deteriorate over time, for example due to natural events such as seismic activity or settling, which may cause the mortar to crack and crumble, so that the bricks are no longer held together. Structural blocks such as cinder blocks, may be made from cast concrete. Structural blocks may be produced with hollow centers to reduce weight, improve insulation and provide an interconnected void between blocks in adjacent layers into which concrete can be poured to solidify the entire wall after it is built. The hollow centers of the structural blocks may allow for the insertion of steel reinforcement to span through the layers in order to increase tensile strength of the wall. Common uses for structural blocks may include crawl space foundation of houses, retaining walls, firewalls, and exterior backup curtain walls for attachment of building envelope systems and veneers.

The hollow centers of structural blocks may be used to improve insulation. The hollow centers may be filled with spray foam insulation, injection foam insulation, polystyrene beads, foam boards, and loose-fill masonry insulation. The hollow center may be filled with expanded-polystyrene (EPS) block foam insulation, substantially increasing the R-value of the resulting wall. The increase in the insulative properties of the structural blocks may allow for the structural blocks to be used to form insulative walls of buildings. Expanded Polystyrene insulation is a lightweight, rigid, closed cell insulation. EPS is available in several compressive strengths to withstand load and back-fill forces. This closed-cell structure provides minimal water absorption and low vapor permanence.

Sorel cement, also known as magnesia cement or magnesium oxychloride, is a non-hydraulic cement that is sometimes used to form blocks. Sorel cement comprises a mixture of magnesium oxide (burnt magnesia) with magnesium chloride. Different ratios can be used, but some examples have the approximate chemical formula $Mg_4Cl_2(OH)_6(H2O)_8$, or $MgCl_2 \cdot 3Mg(OH)_2 \cdot 8H2O$, corresponding to a weight ratio of 2.5-3.5 parts MgO to one-part $MgCl_2$. Sorel cement can withstand 10,000-12,000 psi of compressive force whereas standard Portland cement can typically only withstand 7,000-8,000 psi. Sorel cement may also achieve higher strength than Portland cement in a shorter cure time. The resistance of the Sorel cement to water can be improved with the use of additives such as phosphoric acid, soluble phosphates, fly ash, or silica. Sorel cement is typically unstable in uses, prone to delamination and difficult to work with.

Various wall systems may be made from Sorel cement, for example firewalls, wall insulation panels, and artificial stones, due to a resemblance with marble. Sorel cement may be incompatible with steel reinforcement because the presence of chloride ions in the pore solution and the relatively low alkalinity (pH<9) of the cement promote steel corrosion. Walls systems made from Sorel cement may be more compatible with glass fiber reinforcement. Sorel cement may be a suitable binder for wood composites as setting of the Sorel cement is not slowed by the lignin and other wood chemicals.

Fire resistant structure panels may be used to create a fire-resistant paneling on the exterior of the structure. Example products include ABB™ blocks and Polycore Panels™. These existing panels are used as exterior panels while having anything to do with the construction building itself, and therefore do not provide sufficient fire resistance for the building.

Referring to FIGS. 1-5, a structural block 12 is disclosed. The structural block 12 may define opposed side ends 14 and 16, opposed side faces 18 and 20, and top and base faces, 22 and 24 respectively, or have other suitable shapes. The structural block 12 may comprise a foam core 32. The structural block 12 may comprise external coating plates 34 on at least one side face 18 or 20, for example the external coating plates 34 may clad opposed inside and outside faces 18 and 20 of the block 12 between the opposed side ends 14 and 16 of the block 12. The external coating plates 34 may be sufficiently adhered to the foam core 32 of the structural block 12, for example through the use of an adhesive 35. The structural block may have suitable dimensions, for example a length 26 of 96 inches, a width 30 of 13⅜ inches and a height 28 of 12 inches. Other shapes and sizes may be used without limitation. The structural block 12 may comprise a series of columnar apertures 38. The columnar apertures 38 may extended between top and bottom faces, 22 and 24 respectively, of the structural block 12 to allow fluid and hence cement communication above and below the block. The columnar apertures 38 may be arranged or otherwise distributed in regular intervals and spacings along the structural block 12, such that the columnar apertures 38 of a block 12 may align in use with plural corresponding columnar apertures 38 of respective structural blocks 12 that may be identical with the structural block 12 when such other respective structural blocks 12 are laid above and below the structural block 12 in staggered conformation. The columnar apertures 38 may be defined within the foam core 32 of each structural block 12, for example if the apertures 38 are drilled, cut, or molded directly out of the foam core 32.

The disclosed block system the pre-existing products were considered to create a new block that encapsulates a unique mix of Magnesium chloride and magnesium oxide cement inside the Styrofoam to prevent almost all of the instability, which normally comes from exposure to outside environments and improper mix ratios.

Embodiments of this document describe a block system that may integrate expanded polystyrene (EPS), which is a fire-resistant, weather-resistant, structurally sound coating that can be mechanically fastened to. The block system may comprise a structurally durable column and beam joined system that may be assembled practically as an entire building envelope, including the roof. The block system may use suitably dimensioned blocks, such as 14"×12"×96" EPS blocks, with a ¾" coating on either side. The blocks may be joined in a staggered design with our flowable core filling material in 6" columns every 16" apart that also runs horizontally along the length of the building wall, allowing for the full structural integrity of the building to be completed (column strength ~5000 psi or greater). These columns and horizontal joining beams may also have a special fiberglass rebar within them.

Referring to FIGS. 1, 2, and 5-6, plural blocks 12 are used to form a structural system 10. The plurality of structural blocks 12 may be arranged in rows 13, for example stacked on each other. The structural blocks 12 of each row 13 may be staggered relative to the structural blocks 12 of adjacent rows 13. Staggering may refer to arranging the blocks 12 in a series of alternating or continually overlapping intervals of distance, for example arranged so as to alternate on either side of a center of the block 12 below. A plurality of cement columns 40 may extend through adjacent rows 13 of the plurality of structural blocks 12 via aligned columnar apertures 38. The extension of the plurality of cement columns 40 through the plurality of structural blocks 12 may form a relatively high-strength structural system.

Referring to the FIGS. 1, 2, and 5-6, the structural system 10 may have various advantages over traditional structural systems. Traditional wood frame wall systems may lack fire and wind resistance, have durability issues, have low thermal insulation, and be prone to rot and mold growth. The structural system 10 may overcome all of the issues with traditional wood fame wall systems. The structural system 10 may comprise fire-resistant properties, for example, the coating plates 34 may have a burn time of over 30 minutes or otherwise have intumescent properties. The plurality of cement columns 40 may provide less fire resistance than the coating plates 34, but may retain a substantial amount of their structural strength even after the entire foam core 32 structure is burned, allowing the plurality of cement columns 40 to continue to hold the building 54 up in the event of a devastating fire. The plurality of cement columns 40 may be formed of relatively high-strength, such as 5000 psi (pounds per square inch), cement, and may be positioned within the structural system at a suitable distance from each other, for example every 2 feet. Each cement column 40 may be able to support a structural amount of weight, for example around 11,000 pounds. The structural system 10 may have a high flexural strength and both the plurality of cement columns 40 and the plurality of structural blocks may be able to move slightly with wind and foundation changes, thereafter retracting back into original positions, which may prevent any damages or cracks to the structural system 10. The materials of the structural system 10 may be inorganic, which may prevent rot. The foam core 32 of the structural blocks 12 may provide sufficient insulative properties, for example the foam core 32 may possess an R-value of R50-R 60, with no additive materials. Traditional wood systems must add extra materials for insulative properties which may be cost and labor intensive, while still only reaching an R-value around R14.

Referring to FIGS. 2-6, the foam core 32 may have suitable properties. The foam core 32 may comprise a suitable material, for example insulative polymeric material such as expanded polymeric foam, for example expanded polystyrene (EPS). The foam core 32 may comprise a suitable EPS, for example, EPS type 1. Each foam core 32 may have a suitable shape and may be cut or molded to shape, for example into a rectangular box or square box shape. A plurality of apertures 38 may be formed in the foam core 32, for example, 6-inch diameter apertures 38 may be formed every 2 feet in the foam core 32, or at other diameters and spacings. The apertures 38 may be formed in the foam core 32 through the use of drill such as a coring drill. A channel, for example an aligned beam slot 36, may thus be formed in the foam core 32 in one or both of the top and base face, 22 and 24 respectively, of the foam core 32. The channel may be formed with a suitable cutting device, such as an electric hot knife. The foam core 32 may be rasped and grooved to allow for the adhesion of the coating plates 34.

Figure 2:
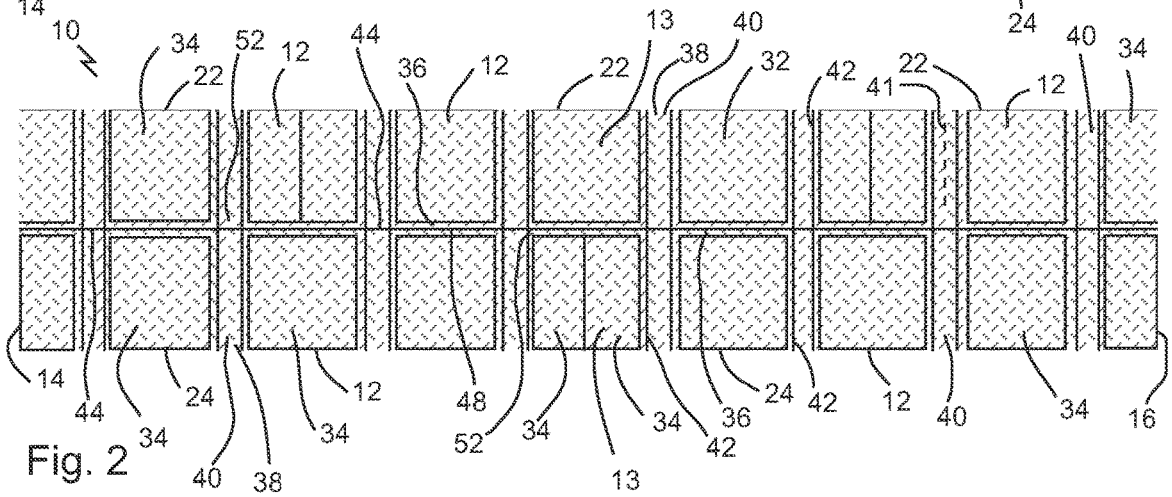
FIG. 2 is a cross-sectional view of the structural system of FIG. 1.

Referring to FIG. 2, the structural system 10 may comprise a plurality of structural beams 48. The plurality of structural beams 48 may extend through or between rows 13 of the plurality of structural blocks 12. The structural beams 48 may be extended at an interface between adjacent rows 13 of structural blocks 12, for example via aligned beam slots 36. The aligned beam slots 36 may be defined within one or both of top and bottom faces 22 and 24, respectively of the structural blocks 12. The aligned beam slots 36 may communicate with the aligned columnar apertures 38 such that the plurality of cement columns 40 and the plurality of structural beams 48 integrally connect to form a structural matrix 52.

Referring to FIG. 2, one or both of the cement columns 40 and structural beams 48 may have a suitable composition, for example, the cement columns 40 and structural beams 48 may comprise Sorel cement and fly ash. Fly ash may comprise primarily of oxides of silicon, aluminum iron and calcium. Magnesium, potassium, sodium, titanium, and sulfur may also be present in fly ash to a lesser degree. When used as a mineral admixture in concrete, fly ash may be classified as either Class C or Class F ash based on its chemical composition. Class F ashes may typically be derived from bituminous and anthracite coals and may comprise primarily of alumino-silicate glass, with quartz, mullite, and magnetite. Class F fly ash may have less than 10 percent CaO. The burning of harder, older anthracite and bituminous coal typically produces Class F fly ash. This fly ash is pozzolanic in nature, and contains less than 7% lime (CaO). Class F fly ash may comprise $SiO_2$, $Al_2O_3$, $Fe_2O_3$, CaO (Lime), MgO, and $SO_3$. Possessing pozzolanic properties, the glassy silica and alumina of Class F fly ash may be coupled with a cementing agent, such as Portland cement, quicklime, or hydrated lime, which may then be mixed with water to react and produce cementitious compounds. Alternatively, adding a chemical activator such as sodium silicate (water glass) to a Class F fly ash may form a geopolymer.

Referring to FIG. 2, one or both of the cement columns 40 and structural beams 48 may have a suitable composition, for example, silica fume. Silica fume may enhance the mechanical and durability properties of concrete. Silica fume, also known as microsilica, (CAS number 69012-64-2, EINECS number 273-761-1) is an amorphous (non-crystalline) polymorph of silicon dioxide, silica. It is an ultrafine powder collected as a by-product of the silicon and ferrosilicon alloy production and consists of spherical particles with an average particle diameter of 150 nm. The main field of application is as pozzolanic material for high performance concrete.

Referring to FIG. 2, one or both of the cement columns 40 and structural beams 48 may comprise phosphoric acid. Phosphoric acid may be used to increase the resistance of cement, such as Sorel cement to water.

Referring to FIG. 2, one or both of the cement columns 40 and structural beams 48 may comprise acrylic emulsion. An acrylic emulsion may contribute to aesthetics, longevity, and bond strength of concrete. The acrylic emulsion may maintain internal moisture and reduce porosity of concrete, which may minimize bacterial growth and oxygen exposure, and prevent deterioration.

Referring to FIG. 2, one or both of the cement columns 40 and structural beams 48 may comprise fiberglass fiber to form fiber-reinforced concrete. Fiber-reinforced concrete may have a relatively higher durability and reduced crack widths due to plastic shrinkage, long-term drying shrinkage, and thermal changes. The fiberglass fibers in the fiber-reinforced concrete may function to keep the cracks tightly closed. Because concrete cannot be prevented from cracking, the goal may be to keep the cracks tightly closed. For example, Bon 32-500 1 Pound Bag ¾-Inch Anti-Crak Concrete Fibers™.

Referring to FIG. 2, one or both of the cement columns 40 and structural beams 48 may have a suitable composition, for example, the cement columns 40 and structural beams 48 may comprise sand such as stucco sand. Stucco sand may be mixed with cement and is used to create a textured and fine sand finish.

Suitable proportions of components may be used to form the cement columns 40 and/or structural beams 48. Once the desired combination of components has been prepared, for example in the form of a cement pre-cursor slurry, the mixture may be poured onto a vibrating table to remove air from the mixture. A suitable amount of Sorel cement may be used to form structural beams 48, for example between 40 and 60% by weight of wet components. A suitable amount of fly ash may be used to form the structural beams 48, for example between 1 and 5% by weight of wet components. A suitable amount of silica fume may be used to form the structural beams 48, for example between 1 and 10% by weight of wet components. A suitable amount of phosphoric acid may be used to form the structural beams 48, for example between 0.5% to 3% of cement weight, for example 1%. A suitable amount of acrylic emulsion may be used to form structural beams 48, for example between 0.5 and 5% by weight of wet components, for example 1%. A suitable amount of fiberglass fiber may be used to form structural beams 48, for example between 0.5% to 3% by weight of wet components, for example 1%. A suitable amount of stucco sand may be used to form structural beams 48, for example between 15 and 50% by weight of wet components. A suitable amount of water may be added, for example between 1 and 8% by weight of wet components. In one example a precursor cement mix is made comprising 566 grams of $MgCl_2$ in water, 424 grams of MgO, 68 grams of Type F fly ash, 52 grams of silica fume, 7 grams of phosphoric acid, 16 grams of acrylic emulsion, 1 gram of fiberglass fiber, 716 grams of stucco sand, and 40 grams of water (for workability). This precursor cement mix may be similar to the precursor cement mix of the external coating plates 34, however, this precursor cement mix may not contain light materials (perlite) to ensure the high compressive strength and flexural strength. The example may allow the columns 40 to be relatively highly rated in load bearing capacity, for example the columns may have a compressive strength of 5000 psi or more. The composition of the precursor cement may allow for the formation of fire-resistant material.

Referring to FIG. 2, the structural beams 48 may comprise reinforcing elements. Structural beams 48 may comprise rebar 44, for example fiberglass rebar, silica rebar or basalt rebar. Metal rebar may also be used. Rebar 44 beams may be laid through or between rows 13 of the plurality of structural blocks 12, forming the structural beams 48. Depending on the size of the slots 36, the pouring of the cement pre-cursor slurry may add cement to structural beams 48. The rebar 44 may increase the tensile strength of the structural beams 48 and the resulting wall. The use of non-corrosive rebar 44, such as fiberglass rebar, silica rebar or basalt rebar, may prolong the lifespan of the cement in the structural beams 48. The use of non-conductive rebar 44, such as fiberglass rebar, silica rebar or basalt rebar, may restrict electricity from flowing through the structural beams 48, for example by lightning or other events.

Figure 5:
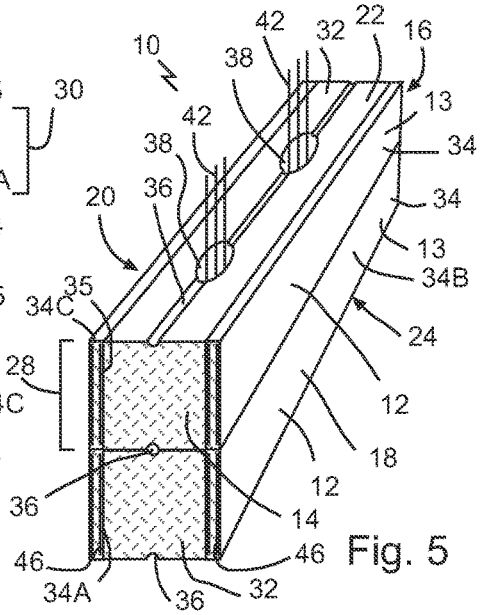
FIG. 5 is a cross-sectional perspective view of the structural system of FIG. 1, taken along the 5-5 sectional line of FIG. 1.
Figure 6:
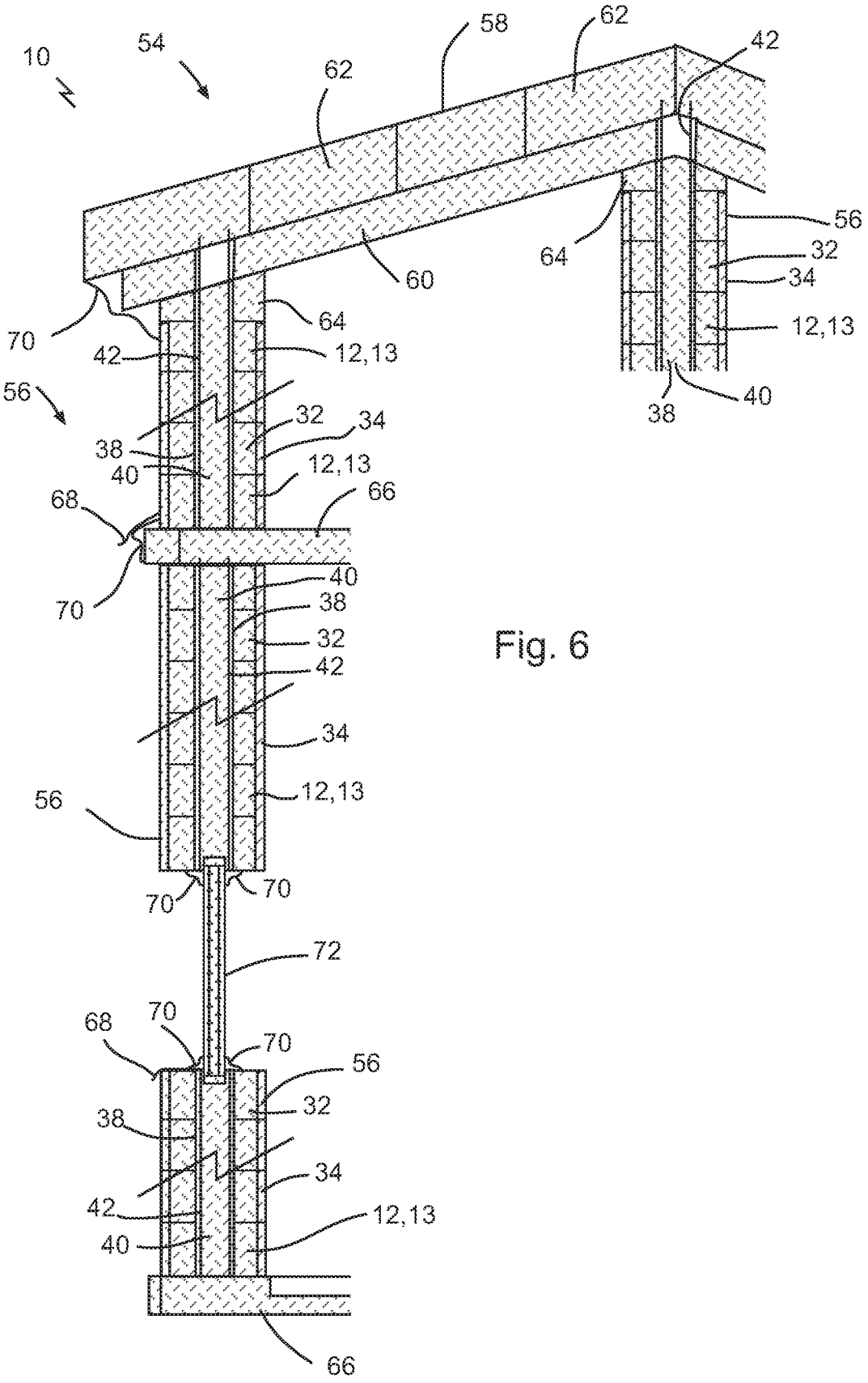
FIG. 6 is a cross-sectional view of a building which has been constructed using the structural system of FIG. 1.

Referring to FIGS. 2 and 5-6, the plurality of cement columns 40 may comprise reinforcing elements, such as rebar 42, for example fiberglass rebar, silica rebar or basalt rebar. Before pouring of the cement pre-cursor slurry, the rebar 42 may be extended through adjacent rows 13 of the plurality of structural blocks 12 via the aligned columnar apertures 38. The structural system 10 may be structured to form a wall 56 of a building 54. The rebar 42 of the plurality of cement columns 40 may secure to one or both a roof 58 and a floor above and below the wall 56, respectively. A roof 58 may be defined by roof beams 60 and roof panels 62, although other elements may for a roof. The rebar 42 may be secured to a suitable point of the roof or understructure, such as a roof beam 60 of the roof 58. The floor may be defined by a floor joist 66, which may form a suitable attachment point for the rebar 42 to be secured to the floor joist 66 of the floor. The rebar 42 may increase the tensile strength of the cement columns 40. The use of non-corrosive rebar 42, such as fiberglass rebar, silica rebar or basalt rebar, may prolong the lifespan of the cement in the cement columns 40. The use of non-conductive rebar 42, such as fiberglass rebar, silica rebar or basalt rebar, may restrict electricity from flowing through the concrete columns 40, for example by lightning or other events.

Referring to FIGS. 1, and 3-6, the external coating plates 34 may have a suitable composition. The external coating plates 34 may comprise Sorel cement. For example, the external coating plates 34 may comprise or be made of magnesium chloride and magnesium oxide. The external coating plates 34 may define a suitable shape, for example, an inside face 34A, an outside face 34B and edges 34C. The inside face 34A of the external coating plate 34 may be adhered to the foam core 32. In some cases, each block 12 may have only a single plate 34, and in others, the sorel cement may coat or envelope two or more or all of the sides of the block 12.

Referring to FIGS. 1, and 3-6, the external coating plates 34 may have a suitable composition. For example, external coating plates 34 may comprise Sorel cement, type F fly ash, phosphoric acid, stucco sand, perlite and water. Perlite may act as a lightening agent to create a lightweight concrete. A suitable amount of Sorel cement may be used to form external coating plates 34, for example between 40 and 70% by weight of wet components. A suitable amount of fly ash may be used to form the external coating plates 34, for example between 1 and 10% by weight of wet components. A suitable amount of phosphoric acid may be used to form the external coating plates 34, for example between 0.1% to 3% of cement weight, for example 1%. A suitable amount of stucco sand may be used to form the external coating plates 34, for example between 15 and 40% by weight of wet components. A suitable amount of perlite may be used to form the external coating plates 34, for example between 5 and 20% by weight of wet components. A suitable amount of water may be added, for example between 0.5 and 10% by weight of wet components. In one example a precursor cement mix for plates 34 is made comprising 36.2 kilograms of $MgCl_2$ in water, 22.68 kilograms of MgO, 4.4 kilograms of Type F fly ash, 454 grams of phosphoric acid, 20 kilograms of stucco sand, 8 kilograms of perlite and 1 kilogram of water for workability. The composition of the precursor cement may allow for the formation of fire-resistant material.

Referring to FIGS. 1-6, the Sorel cement used in the external coating plates 34, adhesive 35, concrete columns 40 and concrete beams 48 may have a suitable composition. For example, the Sorel cement may comprise a ratio of about 5:1:13 of MgO, $MgCl_2$ and $H_2O$. The custom Sorel cement composition may provide adhesive properties to the Sorel cement. The adhesive properties of the Sorel cement used in the external coating plates 34, adhesive 35, concrete columns 40 and concrete beams 48 may allow the external coating plates 34, adhesive 35, concrete columns 40 and concrete beams 48 to adhere tightly to the foam core 32.

Figure 3:
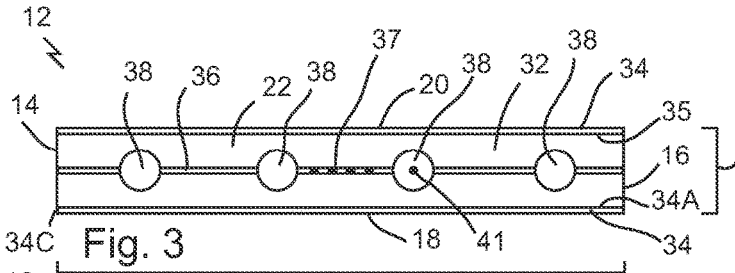
FIG. 3 is a top elevation view of a block of the structural system of FIG. 1.
Figure 4:
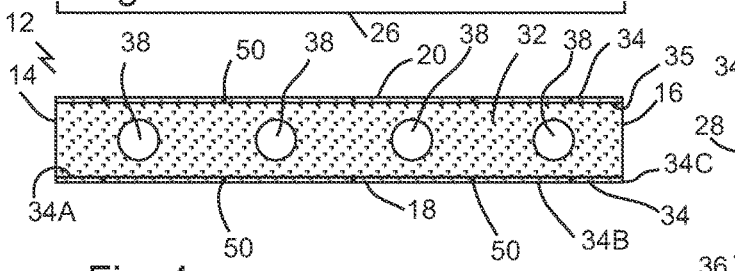
FIG. 4 is a cross-sectional view of the block of FIG. 4.

Referring to FIGS. 3-5, the structural blocks 12 may be formed by adhering the external coating plates 34 to the foam core 32. The external coating plates 32 may be secured to the foam core 32 of the structural blocks 12 via an adhesive 35. The adhesive 35 may have a suitable composition, for example the adhesive 35 may comprise Sorel cement. The adhesive 35 may comprise type F fly ash, phosphoric acid, stucco sand, and water. A suitable amount of Sorel cement may be used to form the adhesive 35, for example between 50 and 80% by weight of wet components. A suitable amount of fly ash may be used to form the adhesive 35, for example between 1 and 10% by weight of wet components. A suitable amount of phosphoric acid may be used to form the adhesive 35, for example between 0.1% to 3% of cement weight, for example 1%. A suitable amount of stucco sand may be used to form the adhesive 35, for example between 15 and 40% by weight of wet components. A suitable amount of water may be used to form the adhesive 35, for example between 0.5 and 10% by weight of wet components. In one example a precursor cement mix is made comprising 36.2 kilograms of $MgCl_2$ in water, 22.68 kilograms of MgO, 4.4 kilograms of Type F fly ash, 454 grams of phosphoric acid, 20 to 30 kilograms of stucco sand, and 1 kilogram of water (for workability).

Referring to FIGS. 4 and 5, the external coating plates 34 may comprise reinforcing elements. The external coating plates 34 may be embedded with one or more of rebar columns 50 and reinforcing mesh 46. The rebar columns 50 may comprise suitable material, for example, fiberglass rebar, silica rebar or basalt rebar. The reinforcing mesh 46 may comprise a suitable material, for example, fiberglass mesh. The reinforcing mesh 46 may increase the strength and reduce cracking of the external coating plates 34. The rebar columns 50 of the external coating plates 34 may increase the tensile strength of the external coating plates 34.

Membrane System for Roof, Deck, and Balcony Use

Membrane roofing is a type of roofing system for buildings, recreational vehicles, ponds, pools, and in some cases tanks. It may often be used to create a watertight covering to protect the interior of a building. Membrane roofs are most commonly made from synthetic rubber, thermoplastic (PVC—poly vinyl chloride or similar material), or modified bitumen. Membrane roofs are most commonly used in commercial applications, though they are becoming increasingly common in residential application.

There are three types of single-ply, or elastoplastic, products in use today that are defined by the chemical properties they possess. These are: (1) Cured (or vulcanized) elastomers, (2) Uncured elastomers, and (3) plastomers. Cured Elastomers (often referred to as Thermoset), are synthetic rubbers that have undergone the vulcanization or "Curing" process. Seams of materials are bonded by adhesives or chemicals, which over time weaken and separate unless maintained or reinforced. The finished roof's thickness is usually between 30 and 120 mils (thousandths of an inch) (0.75 mm to 1.50 mm). The most commonly used Cured Elastomer membranes are Ethylene Propylene Diene Monomer (commonly EPDM) and Neoprene™, although all thermoset products combined fail to account for more than 10% of all commercial roofing. The average lifespan of thermoset membranes is between 15-20 years. Uncured Elastomers (sometimes grouped with Thermosets for simplicity) may be installed in a manner similar to thermoplastics in that they can be heat or solvent welded. The material then cures over time once exposed to the elements, and then exhibits the same qualities as vulcanized elastomers. The most commonly used Uncured Elastomers are Chlorosulfonated Polyethylene (CSPE), Chlorinated Polyethylene (CPE), Polyisobutylene (PIB), Nitrile Butadiene Polymer (NBP), although none of the products are known to be commonly used in the last decade, in part due to environmental concerns brought up regarding the chemical curing processes in the late 90s. Thermosets are often referenced for their easy installation methods, high chemical resistances, having higher impact resistances (for some membranes), and resistance to high temperatures. Plastomers (often referred to as Thermoplastics) are membranes that are heat welded and develop strength in the welds at least equal to the original membrane material, forming a much stronger bond than chemically bonded thermosets. A commonly used thermoplastics is PVC.

These application types of membrane roofing show distinct advantages over the previously more common flat roofing method of asphalt and gravel (commonly referred to as Built-Up-Roofs or "BUR"). In asphalt and gravel application, it can be very difficult to create a proper seal at all seams and connection points. This can cause a roof to leak early in its lifespan, and require much more maintenance. When installed correctly, newer materials are either seamless, or have seams as strong as the body. This eliminates most of the leakage concerns associated with flat roofing systems. Repairs for asphalt and gravel roofs can also be problematic, largely because it is difficult to locate the exact point of a leak. Newer systems can be patched relatively easily because breaks and leaks are easier to locate.

Originally, asphalt roofing required a layer of gravel above it for two reasons. First, asphalt with direct exposure to sunlight degrades much faster, mainly due to the expansion and contraction throughout a day, and also the damage created by UV rays. Secondly, asphalt needs weight above to hold it down, because it sits on the top of a building, instead of being attached to it. Each of the newer types of membrane roofing systems contain materials that resist expansion and contraction, as well as reflect much of the UV rays. In addition, because these membranes either lack seams or have stronger bonding than traditional BUR seams, when expansion and contraction does occur does not create leaks and breaks at these seams. These newer roofing systems are also usually attached directly to the top of a building, which eliminates the need for excess weight above.

Even the best vinyl or other polymer membrane roof materials have drawbacks. Leaks in membrane roofs can happen for several reasons, including: punctures in, or damage to, the membrane, shrinkage, incorrectly installed or improper flashing, and wrinkles extending into roof seams. Flat roofs or other exterior horizontal surfaces may also become damaged to exposure to one or more of UV and other exterior elements that cause deterioration, leaks due to puncturing or error in workmanship, water ponding, allowing water and moisture to seep through, structural movement/expansion causing tears, blistering/shrinkage, and/or biological growth.

The membrane and roof designs of the present disclosure are designed to address the challenges and issues with exterior flat surfaces such as decks, balconies, and flat roofs. What these materials provide is a solution to leak, peeling, and other problems today. This membrane and roof design may withstand all exterior circumstances while maintaining integrity, longevity and protection against impact and other damages. These systems may also provide a relatively easy application process with the membrane completed in the manufacturing stage, having the substrate waterproofed, and then chemically adhered to the membrane.

Figure 7:
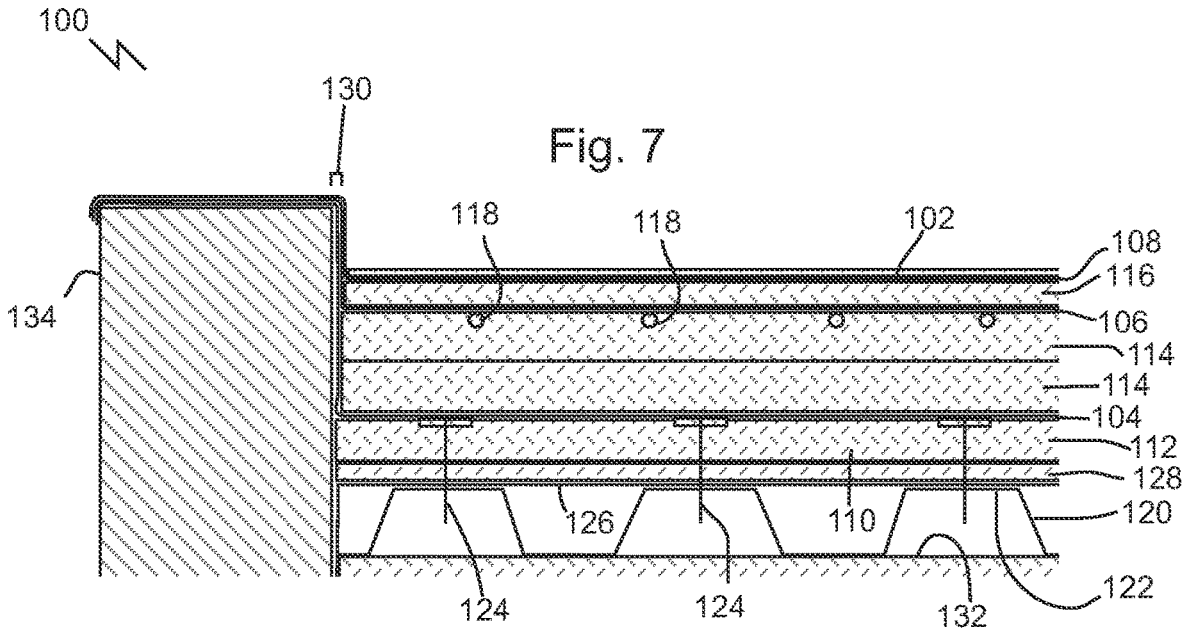
FIG. 7 is a cross-sectional view of a membrane system installed on a roof of a building.
Figure 10:
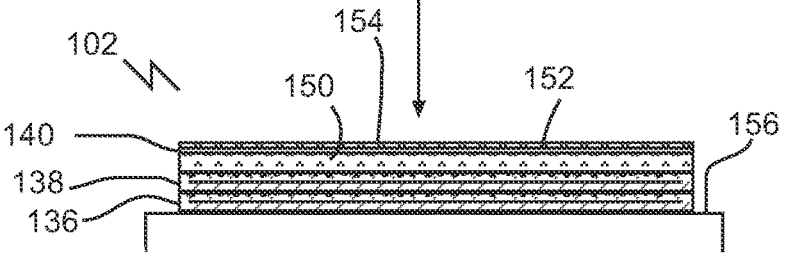

Referring to FIG. 7, a building membrane system 100 is illustrated. The system 100 may comprise one or more membrane layers 102. The system 100 may comprise one or more insulative panel layers 110. Referring to FIG. 10, each membrane layer 102 may have plural sub-layers, for example a base layer 136, an intermediate layer 138, and a top layer 140. Various of the sub-layers, such as layer 136, 138, and 140, may comprise suitable components, such as acrylic polymer, sand or silica, and reinforcing mesh or fibers. This document discloses embodiments of a membrane composition that may be used for covering horizontal exterior surfaces (balconies, decks, roofs) and used in combination with a proprietary roof system. In some cases, the membranes here may be used for other types of cladding, such as vertical wall cladding. The membrane layer 102 may be adhered on a substrate, such as a roof 132. The substrate may be covered by a (wet applied) similar compound to the base layer 104 of the membrane system 100.

Referring to FIG. 7, the system 10 may incorporate plural layers. A plurality of membrane layers 102 and a plurality of insulative panel layers 112 may be stacked together and adhered in alternating fashion over a substrate (such as a roof 132) of a building. Alternating fashion may refer to a membrane layer 102 on top of an insulative panel layer 112, followed by an insulative panel layer 112 over the membrane layer 102, and so on. Each of the plurality of membrane layers 102 may be flexible and waterproof. The plurality of membrane layers 102 may comprise a base membrane layer 104, one or more intermediate membrane layers 106, and a top membrane layer 110.

Referring to FIG. 7, this system 100 may form an effective water sealed liner for a number of reasons. The first wet applied base layer 104 on the substrate already waterproofs the substrate completely. The initial base layer on top of the initial EPS (from the Q-deck up) already waterproofs the entire system in some embodiments. The subsequent layers 106 form redundant seals that increase longevity and isolate and minimize leaks. A multi-layered system may prevent any minor penetrations of the top from reaching anywhere close to the roof and causing water or other damage to the building. The material is waterproof and even if ponding were to occur, the moisture cannot seep through. The membrane composition may be flexible, adheres well to the waterproofed substrate, moves with the expansion of the substrate and can stand exterior circumstances such as ultraviolet (UV), moisture, freeze and thaw. Expansion joints or gaps 130 may be made to accommodate for movement of the substrate/building. This flexibility also prevents blistering and shrinkage. The top/design layer 108 may have a hard composition that can withstand human traffic and expected impacts. The material may be impact proof and even if punctured, can be patched in the exact spot of penetration without affecting other parts/areas of the system. The top layer 108 may also be designed into different aesthetically pleasing designs my manipulating the wet material when it is curing, for example to give the appearance of wood, marble, stone, tile, or other designs. The final membrane (base layer+middle layer+top/design layer) may allow for an impact resistant surface that is also UV resistant. All materials in this system may be inorganic and/or provide an alkaline environment that does not allow for a favorable environment for biological growth. The system may also be installed without requiring highly skilled professionals to apply the system—in some cases a simple brush/roll/trowel on application is sufficient with relatively large room for error compared to traditional flat roof systems.

Referring to FIG. 7, the system 10 may be installed in a suitable fashion. In the example shown, the substrate of the building may comprise one or more of a board surface, such as from a plywood board 128, and a vapor barrier 126, which may be above or below the board surface. The vapor barrier 126 and board surface may be secured to the substrate via a suitable fashion such as fasteners 124 or adhesive. The roof 132 may have a suitable structure, such as a Q deck, such as a steel deck 120. In the example shown, the vapor barrier 126 is fastened to the raised ridges 122 of the deck 120, between the respective valleys. A corrugated deck 120 is not a requirement but is found on many roof systems. A fire barrier may be installed. The membrane system 100 may be installed on the board 128 in the example shown.

Referring to FIG. 7, the system 100 may begin with an insulative panel layer 110, such as a base insulative panel layer 112. The plurality of insulative panel layers may comprise polystyrene, such as EPS. In the example shown, a 2" thick expanded polystyrene type 1 (10 psi) (EPS) insulation may be mechanically fastened down to the q-deck, for example using an adhesive or fasteners 124. On top of this EPS layer 112, may comprise the base membrane layer 104. The base membrane layer 103 may go up to and over the parapet 134 walls as shown if such are present, for example forming crown molding on the building. In the example shown, the method of installing the system 100 may comprise extending membrane layers 104 and others of the plurality of membrane layers up and over a parapet of the building.

Referring to FIG. 7, on top of the base membrane layer 104, one or more intermediate insulative panel layers 114 may be added. The user may add as many EPS panel layers 114 as needed depending on the height restriction or requirements of the roof, or the amount of insulation value needed to achieve the desired R-value of the roof. On top of the layers 114 may be added an intermediate membrane layer 106, for example that covers the EPS layer 114 and runs just up the wall of the parapet 134 as did layer 104. Above the intermediate membrane layer 106 may be the final insulation, the upper insulative panel layer 116, which may be of a suitable variety such as a type 4 EPS (40 psi). Above the panel layer 116 may be a protective top membrane layer 108 adhered to the layer 116. The top membrane layer 108 may be added and in some cases modified for impact protection of the roof system 10.

Referring to FIG. 7, one or more sensors 118 may be embedded in the system 100 to monitor various characteristics of the membrane system 100. In the example shown sensors 118 may comprise moisture and/or temperature sensors in or between layers of the building membrane layer 102/110. In the example shown the sensors 118 are embedded or between the upper layer of intermediate insulative panel layers 114. Inside the higher or upper layers of EPS insulation, the moisture/thermal sensors may be connected to a dash board, controller, or other transmitting and collecting device that can indicate to the user any future leakage or penetration of the roof. The sensors may allow for localized leakage detection points, in order to inform the user of any leaks so the user may act to fix the damaged spots accordingly and precisely. In some cases, the sensors 118 may be arranged in a suitable pattern about the area of the roof, such as in a matrix pattern.

Referring to FIGS. 7 and 10, the top membrane layer 108 may have suitable features. A top membrane layer 108 of the plurality of membrane layers 102 may comprise a protective outer coating. The protective outer coating may be waterproof, for example by application of a sealer 154. The protective outer coating may comprise one or more of: an ultraviolet protector; a surface hardener; and a fire retardant. A decorative outer layer 152 may be applied to the membrane layer 108, for example to provide the appearance of stone, tile, wood, or other surfaces on the membrane layer 108. One or more types of reinforcing material, such as reinforcing mesh or fibers 150 may be present in the layer 108. The protective outer coating may comprise one or more of styrene-acrylic polymer, titanium dioxide (UV protector), silica fume, and perlite. This membrane and roof design may be resistant to UV and exterior elements due to the chemical composition in the final layer 108 of the system.

Referring to FIG. 7, the layers may be adhered together by a suitable adhesive. Layers of the plurality of membrane layers 102 and the plurality of insulative panel layers 110 may be adhered together or to the substrate by an adhesive. The adhesive may comprise a hydrophobic adhesive, which acts to seal from water transfer between layers simply by its application. The adhesive may be made with cement, perlite, and calcium hydroxide. In a suitable adhesive, such as a multi-core EPS adhesive composition, a suitable amount of water may be added to produce the adhesive, for example between 5 and 30% by weight of wet components. A suitable amount of cement, such as Portland cement may be added to the adhesive, such as between 5 and 30% by weight of wet components. A suitable amount of perlite may be added to the adhesive, for example between 5 and 30% of perlite grains by weight of wet components. A suitable amount of perlite dust may be added to the adhesive, for example between 5 and 30% by weight of wet components. A suitable amount of calcium hydroxide or other base such as calcium oxide may be added to the adhesive, for example between 0.1 to 15% by weight of wet components, for example 10% calcium oxide. In one example a wet adhesive is made comprising 100 grams of water, 75-100 grams of Portland cement, 50-100 grams of perlite grains, 100-200 grams of perlite dust, and 10 grams of calcium hydroxide. In some cases, a styrene-acrylic adhesive may be used, for example with magnesium oxide.

Referring to FIG. 7, the substrate or roof 132 may be waterproofed with the wet applied base membrane layer 102. This can be done on decks/balconies/flat roofs that have a plywood or other flat substrate. A wet application may be done by roller and brush or other suitable means. A wet base layer 102 composition may comprise a suitable amount of styrene-acrylic polymer, and silica fume. In one example, 100 grams of styrene/acrylic polymer are mixed with 12 grams of silica fume to provide the wet character of membrane layer 102. The wet layer may be applied by trowel or roller or brush, and the membrane layer 102 adhered on top or formed in place. The rolled membrane layer 102 may be applied on the substrate using a suitable adhesive, such as a urethane adhesive and cement glue for the joints (not shown) between the underlying layer such as panel layer 112. The membrane layer 102 may be notched in a straight line for the 90 degree returns of the substrate.

Figure 8:
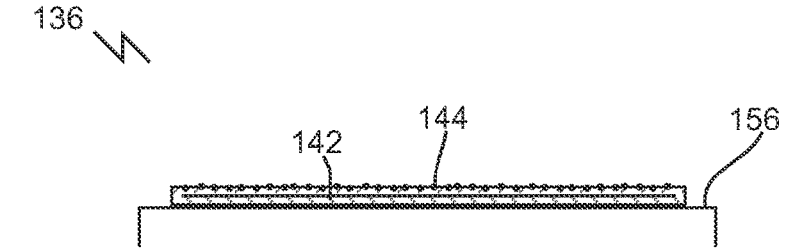
FIGS. 8-10 are cross-sectional views of a method of creating a membrane to use in the membrane system of FIG. 7.
Figure 9:
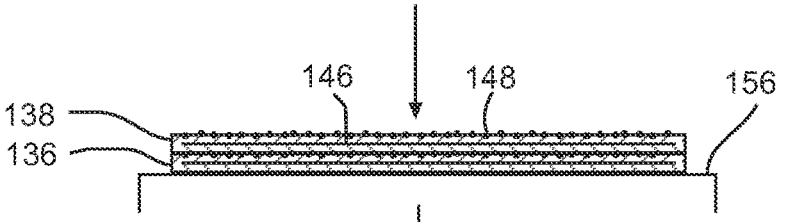

Referring to FIGS. 8-10 the membrane layers 102 of the plurality of membrane layers 102 may be formed in a suitable fashion. In the example shown the layers 102 may comprise a base layer 136, an intermediate layer 138, and a top layer 140. The plurality of membrane layers 102 may comprise one or both of reinforcing mesh, such as layers of mesh 142 and 146, and fiber, such as fibers 150. The plurality of membrane layers 102 may comprise an acrylic polymer. The plurality of membrane layers 102 may comprise sand, silica fume, and cement.

Referring to FIG. 8, the base layer 136 of a membrane layer 102 may be formed in a suitable fashion. The deck base layer 136 of membrane layer 102 may be applied trowel on a plastic surface, such as a table 156, with fiberglass mesh reinforcement in the form of a mesh layer 146. While wet, silica sand 144 may be added, for example blown on top to cover the wet layer 136. This membrane layer 136 may be cured, for example let to set for 12-24 hours at 20-23 degrees Celsius, or at other suitable times and temperatures. The size of the membrane may vary to any suitable dimensions, for example up to the width of 72" to any length that is able to handle by weight. The base layer may comprise a suitable amount of styrene-acrylic polymer, for example 80-99% by weight of wet components. The base layer may comprise a suitable amount of silica fume, for example 8-20% by weight of wet components. Sand may be spayed on top, or otherwise mixed to a suitable amount, such as between 20-90% by weight of wet components. In one embodiment, a suitable precursor mix for layer 136 may be made by mixing 100 grams of styrene/acrylic polymer with 12 grams of silica fume, adding silica sand in an amount to cover the upper or top surface of the layer 136.

Referring to FIG. 9, the intermediate layer 138 of a membrane layer 102 may be formed in a suitable fashion. The layer 138 may be applied trowel onto the layer 136, with fiberglass mesh reinforcement added in the form of a mesh layer 146. While wet, silica sand 148 may be added, for example blown on top to cover the layer 138. This layer 138 may be cured, for example let to set for 12-24 hours at 20-23 degrees Celsius, or at other suitable times and temperatures. The size of the membrane layer 138 may vary to any suitable dimensions, for example enough to cover or equal the surface area of the layer 136. The intermediate layer 138 may comprise acrylic polymer, cement, sand, and reinforcing mesh or fibers. The intermediate layer 138 may comprise a suitable amount of acrylic polymer, for example 20-40% by weight of wet components. The intermediate layer 138 may comprise a suitable amount of cement, such as high early cement, for example 20-40% by weight of wet components. Sand, such as silica sand, may be sprayed on top, or otherwise mixed to a suitable amount, such as between 20-40% by weight of wet components. In one embodiment, a suitable precursor mix for layer 138 may be made by mixing 100 grams of acrylic polymer with 100 grams of high early cement, 100 grams of silica sand, and 1 g of fiberglass fibers.

Referring to FIG. 10, the top layer 140 of a membrane layer 102 may be formed in a suitable fashion. The layer 140 may be applied trowel onto the layer 138, with fiberglass mesh or fiber reinforcement added in the form of loose fibers 150. This top layer 140 may be designed in different aesthetic fashions such as stone, wood, and various designs. The layer 140 may be cured, for example set for 12-24 hours at 20-23 degrees Celsius, or at other suitable times and temperatures. The size of the membrane layer 140 may vary to any suitable dimensions, for example enough to cover or equal the surface area of the layer 138. The layer 140 may comprise acrylic polymer, cement, silica flour, reinforcing mesh or fibers, and a decorative top surface finish. The top layer 140 may comprise a suitable amount of acrylic polymer, for example 20-40% by weight of wet components. The top layer 140 may comprise a suitable amount of cement, such as high early cement, or white cement for more color design potential, for example 20-40% by weight of wet components. Silica flour, may be added to a suitable amount, such as between 20-40% by weight of wet components. In one embodiment, a suitable precursor mix for top layer 140 may be made by mixing 100 grams of acrylic polymer with 100 grams of high early cement, 100 grams of silica flour, and 1 g of fiberglass fibers.

Figure 10A:
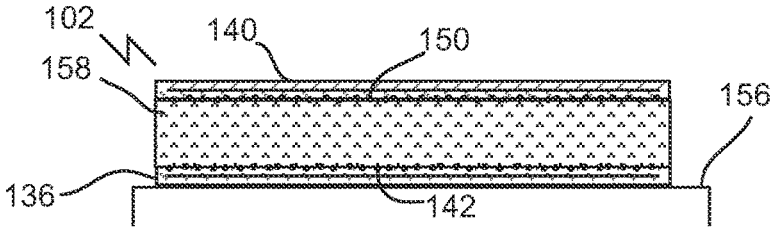
FIG. 10A illustrates a variation of a membrane layer for use in the membrane system of FIG. 7.

Referring to FIG. 10A, another embodiment of a membrane layer 102 is illustrated incorporating an insulative core, such as an insulated foam. Membrane layers 102 may comprise: an insulative membrane panel 158 and membranes, such as layers 136 and 140, adhered to opposed faces of the insulative membrane panel 158. Each membrane layer 136 and 140 may comprise styrene-acrylic polymer, silica fume or magnesium oxide, and reinforcing mesh 142 or fibers 150.

Referring to FIG. 10A, the membrane layer 102 from FIG. 10A may be created in a suitable fashion, forming a multi core roof membrane design. A base membrane layer 104 may be applied, for example by trowel, on a plastic surface such as table 156, with fiberglass mesh 142 reinforcement. This membrane layer 136 may be let to set for 12-24 hours at 20-23 degrees Celsius, or other times and temperatures. A suitable amount of styrene-acrylic polymer may be added to a wet layer 136, such as 80-99% by weight of weight components. A suitable amount of silica fume may be added to layer 136, such as 5-20% by weight of wet components. In one embodiment, layer 136 may be made by mixing 100 grams of styrene-acrylic polymer with 12 grams of silica fume. In another embodiment, a layer 136 may be made by adding a suitable amount of low Tg (glass transition temperature) acrylic polymer, such as between 40-70% by weight of wet components, to a suitable amount of magnesium oxide, such as between 25-60% by weight of wet components. In one embodiment, the layer 136 is made by mixing 100 grams of low Tg acrylic polymer with 75 grams of magnesium oxide. Variants of the membrane may be produced using low Tg acrylic with magnesium oxide, and styrene/acrylic and silica fume may be added, to match the environment. Both variations may have addition of graphite powder for levels of fire resistance, or other fire retardants or intumescent may be added.

Referring to FIG. 10A, on top of membrane layer 136 may be added a suitable foam to form a multi core roof modified layer 102. A suitable foam may be a 1" thick type 4 (40 PSI) Expanded polystyrene (EPS). Workable sizes of the EPS sheets (usually 2'×4') may be used, for example with roof base layer 136 applied on both sides of the EPS foam and allowed to set for 12-24 hours at 20-23 degrees Celsius, or other times and temperatures. Modified EPS may have addition of graphite powder and fiberglass cloth for levels of fire resistance. The modified EPS may come in multiple layers of different thicknesses (for example ¼", ½", 1") for further fire resistance.

Referring to FIG. 7, the membrane layer 102 from FIG. 10A may be used in the system 100 shown or a similar system 100. A multi core EPS adhesive may be added to the roof 132 substrate, such as on board 128, such as the adhesive disclosed above. The adhesive may be applied on the EPS sheets by trowel and laid on the roof substrate, then allowed to set for 24 hours at above 4 degrees Celsius, or other times and temperatures.

A multi core joint filler may be used to fill joints of the modified EPS layers 102 for example from FIG. 10A, for example added on site to fill the joints of the individual EPS sheets. The joints are understood to refer to the gaps between adjacent abutting panels in the same plane. The EPS sheets may have fiberglass mesh over extended the sheet and this material may be applied inside the joints by trowel or brush and allow to set for 24 hours at above 4 degrees Celsius, or other times and temperatures. A suitable filler may comprise acrylic polymer, cement, and silica. A joint filler may comprise a suitable amount of water, such as 10-30% by weight of wet components. A joint filler may comprise a suitable amount of acrylic polymer, for example between 0.1 and 5% by weight of wet components. A joint filler may have a suitable amount of cement, such as Calcium sulfoaluminate cement (CSA), for example between 60-90% CSA by weight of wet components. Silica sand or perlite dust may be added in suitable amounts for workability. In one example, a suitable joint filler is made by mixing 100 grams of water, 5 grams of acrylic polymer, 400-500 grams of Calcium sulfoaluminate cement (CSA), and silica sand or perlite dust added for workability.

Referring to FIG. 7, the membrane layer 102 of FIG. 10A may be incorporated and finished in a system such as system 100 in a suitable fashion. A multi core roof protective coating may be added on finished membranes generally on site. This coating may be applied by a suitable fashion, such as via rollers or brushes and allowed to set at above 4 degrees for 12-24 hours, or other times and temperatures. A suitable coating may comprise styrene-acrylic in a suitable amount, such as 70-95% by weight of wet components. A suitable coating (protective top coating) may comprise titanium dioxide or other UV protector in a suitable amount, such as 7-15% by weight of wet components. A suitable coating may comprise silica fume in a suitable amount, such as between 1 and 10% by weight of wet components. A suitable coating may comprise texanol ester in a suitable amount, such as between 1 and 10% by weight of wet components. A coating may comprise perlite dust in a suitable amount, such as for workability. In one example, a multi core roof protective coating composition is made by mixing, 100 grams of styrene/acrylic, 10 grams of titanium oxide, 2-5 grams of silica fume, 3-5 grams of texanol ester, and perlite dust for workability. A multi core roof protective coating may have additional graphite powder and fiberglass cloth for levels of fire resistance.

Deck Boards

A structural board is usually made of timber that is flat, elongated, and rectangular with parallel faces that are longer and wider than they are high. Structural boards are used primarily in carpentry, and are critical in the construction of ships, houses, bridges, and many other structures such as shelves and tables. Structural boards may also be used to form flooring surfaces, such as primary floors, sub-floors, work surfaces on scaffolding, or decks.

A deck is a flat surface capable of supporting weight, similar to a floor, but typically constructed outdoors, often elevated from the ground, and usually connected to or adjacent a building, such as a residential house. Different types of deck or decking boards are available, such as wood and composite decking boards. To form a deck, decking boards are typically laid as strips (typically 120 mm wide) on top of an underlying framework of other boards. As decks are typically outside, the decking boards need to be able to endure in the elements of the given climate. Different climates present different elemental challenges that the deck boards need to be able to withstand, such as those from heat, humidity, cold, rain, hail, snow, wildlife, and insects. Deck boards may have suitable dimensions, such as a width that is less than 2.5 inch, a thickness that is less than 1.5 inch (for example 1 inch), and a variable length. Most deck board manufacturers produce lengths of 12, 16, or 20 feet, although other dimensions may be used.

A deck may be built from boards made of pressure-treated wood. Pressure-treated wood is long lasting and holds up to wet and icy conditions, although pressure-treating chemicals are known to be toxic. Both softwood and hardwood decks need to be finished after installation using either an oil or varnish to prevent weathering, wear, mold, algae and wood-boring insects. Even pressure-treated wood decks are at risk from suffering from wood rot, wood swelling, shifting, warping and shrinking, structural weakness, cracked boards, pest infestation, mold, algae and protruding nails.

A deck may also be built from boards made of suitable plastic materials, such as polyvinyl chloride (PVC). Unlike some other wood-alternative decking materials, PVC decking boards are not made with any wood. PVC decking boards are made completely from plastic instead of from a combination of materials. Producing PVC decking boards is a relatively difficult process called extrusion or co-extrusion. The deck board core is coated and bound with an outer plastic shell, but the materials can be temperamental and hard to work with. Commercial production is challenging, not only for this reason, but also because about one eighth of the deck boards produced are considered unsellable and therefore scrapped. The fragile nature of this production process requires careful ingredient mixing and precise execution. Compared to other synthetic decking products, and compared to all other decking products, PVC is the most expensive decking option. The 100% PVC makeup of the board makes it costlier than the wood powder/plastic mix used in some composite decking boards. This cost means that plastic, for example PVC, boards will be a more expensive investment up front than other options. PVC and other plastic boards lack the realistic feel of wood, and although manufacturers form the product with a realistic wood grain or brushstroke, some contractors and homeowners simply do not like the artificial sheen of the product. Wear will also show over the life of the product, and unlike with wood products, stains and scratches cannot be removed or buffed out. PVC and other plastic decking boards are also relatively more combustible and are prone to cracking than treated wood or composite boards.

Composite decking is an alternative to wood and plastic boards, and may be made with plastic and wood. Composite decking is becoming more popular as it is eco-friendly in nature, minimizing deforestation and in some cases, using recycled materials. Composites and synthetics typically require no preservative pre-treatment as such as naturally resistant to elemental challenges. Some of the composite decking presently available is made from recycled wood and plastic and, although lacking the natural wood appearance, can be cheaper and easier to maintain than wood decking. Composite boards are manufactured as a finished product, and there may be no need to stain, sand, or paint the boards. Composite lumber often has a plastic-like or synthetic appearance and although manufacturers do mold the product with a wood grain or brush stroke pattern, the finished product may still have an artificial sheen analogous to plastic boards. Capped composite decking is a particular type of composite decking, and includes a thin, for example 1/16 inch, PVC-like veneer, or cap, secured over and protecting a composite board underneath. The cap is also formulated differently than the composite underneath, in order to provide increased fade, stain, and scratch resistance. Capped composite decking is more expensive than both normal composite decking and wood decking because of the more involved manufacturing process involved to add the second, co-extruded layer to the board. Capped composites also lack the feel of real wood and although manufacturers form the product with a realistic wood grain or brush stroke, some contractors and deck owners will not accept the artificial sheen. Capped composites, although formulated to resist fading, stains, and scratches, will still show some wear over time, even if such wear occurs at a lesser rate than a normal composite or a real wood product. Manufacturers of capped composite boards will often leave one side or face, such as the bottom face, uncapped to prevent the material from expanding and mushrooming out of the corners of the boards—doing so allows the material within to expand and contract naturally during varying weather conditions, without causing lasting damage. A minority of manufacturers use four-sided capping processes providing a reversible, completely sealed, decking board for protection against the elements. Emulated wood grain patterns may differ on either face to provide more versatile design options. Composite deck boards can be sold in either grooved or solid-sided versions. A grooved composite board may be fastened with hidden deck fasteners or clips, while the solid board is typically face-screwed.

Referring to FIGS. 10, and 15-17, a composite structural board 210 is disclosed. The composite structural board 210 comprises a wood board core 230 and an external resilient cement coating 34. The composite structural board 210 may comprise an internal mesh layer 232 encasing the wood board core 230. The structural board 210 may be formed into a deck board, and may have any suitable dimensions, for example the structural board 210 may be 1⅛ inch thick, 5½ inch wide, and a suitable length such as 96 inches. The structural board may be formed by a suitable method. For example, the wood board core 230 may be encased with the mesh layer 232, before having the external resilient cement coating molded around the wood board core 230 and mesh layer 232, in order to form the composite structural board 210. The composite structural board 210 may be designed to address all the challenges and downfalls of traditional deck systems. For example, the structural board 210 may be relatively durable, flexible, economical, versatile, aesthetic, efficient to manufacture and easy to apply and work with, compared to traditional plastic, composite, or wood deck systems.

Figure 12:
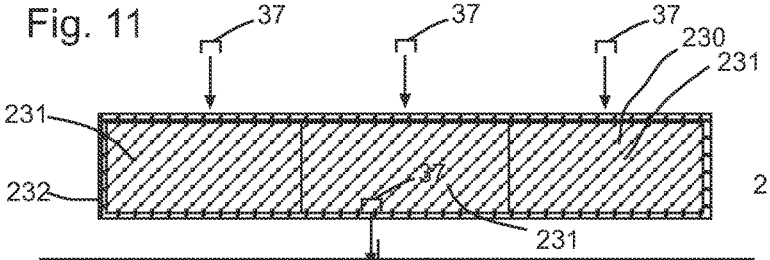
FIG. 12 is a cross-sectional view of a wood board core of the composite structural board of FIG. 1.
Figure 14:
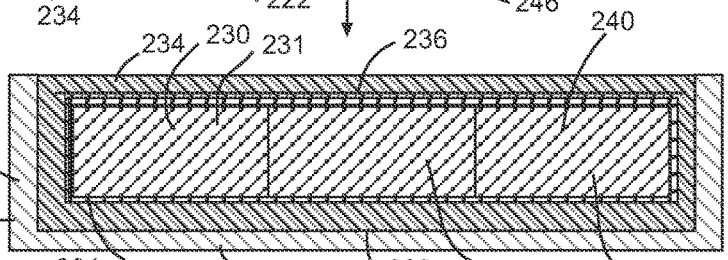
FIG. 14 is a cross-sectional view of the wood board core of FIG. 2 encased in external resilient cement in the board mold of FIG. 3.
Figure 15:
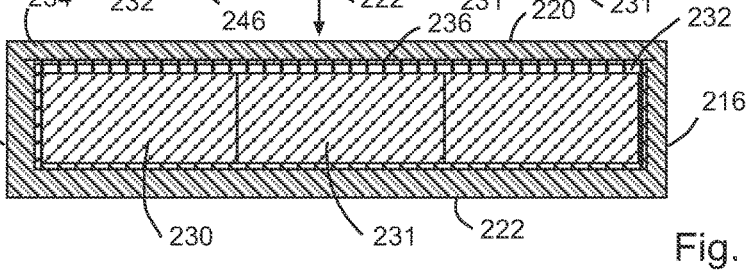
FIG. 15 is a cross-sectional view of the composite structural board of FIG. 1 after removal from the board mold.

Referring to FIGS. 12, 14 and 15, the wood board core 230 may have a suitable structure. The wood board core 230 may comprise a plurality of wood beams 231. The plurality of beams 231 may be secured together by an adhesive. The adhesive may be a suitable adhesive, for example, a hydrophobic wood adhesive. A suitable beam 231 may be used to form the wood board core 230, for example suitable beams may be ¾ inches thick, 1½ inches wide, and a suitable length such as 95 inches—in the example shown three of such beams are illustrated as secured together by the hydrophobic adhesive to form the wood board core 230. The plurality of beams 231 may be cut from any wood suitable for use in decking applications, for example pine. The wood board core 230 may include a hydrophobic pre-treatment seal coating, for example, the hydrophobic wood adhesive may act as the hydrophobic seal pre-treatment coating. A seal coating may be applied around the entire extremity of the wood board core to provide the core with hydrophobic character.

Referring to FIGS. 12, 14, and 15, the hydrophobic adhesive may have a suitable composition, for example, the adhesive may comprise a styrene-acrylic polymer. Styrene-acrylic polymers offer excellent hydrophobic characteristics, for example superior water resistance and moisture vapor transmission rate when compared to other acrylic polymers. Styrene itself is a hydrophobic monomer, making it possible to produce styrene-acrylic polymers with low particle sizes, which may result in polymers that are ideal for certain applications, such as wood adhesives. Other properties of styrene-acrylic emulsion polymers include good weatherability and stain resistance, broad tensile/elongation balance, ability to crosslink, high pigment-binding capacity, ideal gloss, film strength, resistance to removal by detergents, and good adhesion to common substrates, including wood. Acrylic-based monomers may combine with styrene to form a styrene-acrylic emulsion polymer. A suitable acrylic-based monomers may be used, such as methyl acrylate, butyl acrylate, ethyl acrylate, and 2-ethylhexyl acrylate.

Referring to FIGS. 12, 14, and 15, the hydrophobic adhesive may have a suitable composition, for example, the adhesive may comprise sand. The adhesive may have a suitable composition, for example, the adhesive may comprise fly ash. Silica sand, also known as quartz sand, white sand, or industrial sand, may be made up of two main elements: silicon and oxygen. Specifically, silica sand may refer to silicon dioxide ($SiO_2$). The most common form of $SiO_2$ is quartz. Quartz is a chemically inert and relatively hard mineral. In order to be considered a silica sand, the material must contain at least 95% $SiO_2$ and less than 0.6% iron oxide. If the sand does not meet this criterion, it will qualify as what's often called 'regular' sand.

A suitable proportion of components in the wood adhesive may be used. A suitable amount of the styrene-acrylic polymer may be used, for example between 20 and 40% by weight. A suitable amount of fly ash may be used, for example between 10 and 45% by weight. A suitable amount of silica sand or sand may be used, for example between 10 and 70% by weight. In one example, a wood adhesive may be formed by mixing 150 g acrylic/styrene emulsion, 100-150 g type-F fly ash, and 150-450 g silica sand.

Referring to FIGS. 12, 14 and 15, the internal mesh layer 232 may have a suitable structure. The internal mesh layer 232 may comprise a suitable material, such as fiberglass. Fiberglass mesh may be a neatly woven, crisscross or other pattern of fiberglass thread with numerous applications, such as formed as a tape. Fiberglass mesh may function cooperatively with an adhesive, as fiberglass mesh may allow the adhesive to create a stronger bond with the target surfaces. The inner mesh layer 232 may have a suitable weight, for example between 5-10 ounces per square yard, for example 6 ounces per square yard. The internal mesh layer 232 may be secured to the wood board core 230 via a suitable mechanism, for example by staples 37 (FIG. 12) or fasteners. The internal mesh layer 232 may cooperate with the hydrophobic adhesive to form the core of the board.

Figure 13:
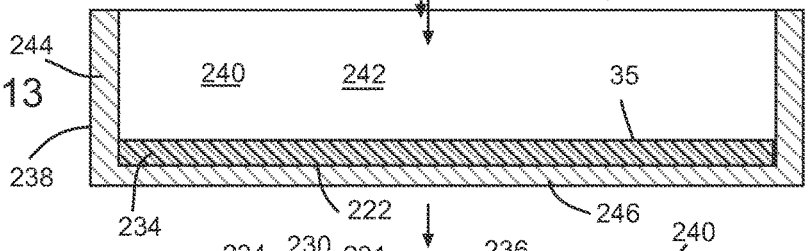
FIG. 13 is a cross-sectional view of a base layer of an external resilient cement coating poured in a board mold.

Referring to FIGS. 13-15, the external resilient cement coating 234 may have a suitable composition. The external resilient cement coating 234 may comprise a polymerized cement mix composition. The polymerized cement mix composition may be formed by mixing Portland cement and a plasticizer. Portland cement may refer to the binding ingredient used in concrete mixes with or without supplementary cementitious materials. High early (HE) Portland cement is a high early strength cement which has been extensively utilized in precast concrete manufacturing to allow quick form turnaround time. HE Portland cement may also be used in cast-in-place applications where it is desired to put the concrete element into service rapidly or during cold weather conditions.

Referring to FIGS. 13-15, the external resilient cement coating 234 may comprise various other suitable components. For example, silica fume may be added to the external resilient cement coating 234.

Referring to FIGS. 13-15, the external resilient cement coating 234 may comprise a superplasticizer. Superplasticizers (SPs), also known as high range water reducers, are additives used in making high strength concrete. Plasticizers are chemical compounds that enable the production of concrete with approximately 15% less water content. Superplasticizers may allow reduction in water content by 30% or more. These additives are employed at the level of a few weight percent. Generally, superplasticizer can be classified into such types: purified lignosulfonates, carboxylate synthetic polymers, sulfonated synthetic polymers and synthetic polymers with mixed functionality cementitious materials. Compounds used as superplasticizers include sulfonated naphthalene formaldehyde condensate, sulfonated melamine formaldehyde condensate, acetone formaldehyde condensate and polycarboxylate ethers. Superplasticizers may slow the curing of concrete.

Referring to FIGS. 13-15, the external resilient cement coating 234 may comprise sand, such as stucco sand. Stucco sand may be mixed with the external resilient cement coating 234 to create a textured and fine sand finish. Stucco sand may be mixed with cement and is used to create a textured and fine sand finish on homes and garages. This can have different colors and different sized granules, depending on your geographic location but should be available in most cases.

Referring to FIGS. 13-15, the external resilient cement coating 234 may comprise suitable components. In one case the coating 234 has an acrylic emulsion. The external resilient cement coating 234 may comprise fiberglass fiber, to form fiber-reinforced concrete.

Referring to FIGS. 13-15, the external resilient cement coating 234 may comprise an air detraining admixture may be used, for example Air Minus™, may be added to the external resilient cement coating 234. The addition of an air detraining admixture may reduce the amount of concrete rejected due to high entrained air content. The addition of air detraining admixture may have numerous other benefits, for example, allowing high speed mixing of cement and fly ash without foaming, increasing the compressive strength of the concrete, counteracting the entrained air caused by the newer generation of superplasticizers, and maintaining slurry densities. Water may be added to the external resilient cement coating 234, and may function to increase the workability of the cement coating 234. Using an admixture may increase the unit weight of concrete, and may be recommended for the production of heavyweight concrete.

Suitable proportions of components may be used to form the resilient cement coating 234. Once the desired combination of components has been prepared, for example in the form of a resilient cement pre-cursor slurry, the mixture may be poured onto a vibrating table in a deck board mold 238 and may be vibrated to remove air from the mixture. A suitable amount of HE Portland cement may be used to form the external resilient cement coating 234, for example between 15 and 50% by weight of wet components. A suitable amount of acrylic emulsion may be used to form the external resilient cement coating 234, for example between 10 and 40% by weight of wet components. A suitable amount of silica fume may be added, for example between 1 and 10% by weight of wet components. A suitable amount of superplasticizer may be used, for example between 0.5 and 3% by weight of wet components, for example 1%. A suitable amount of stucco sand may be added to the external resilient cement coating 234, for example between 15 and 65% by weight of wet components. A suitable amount of fiberglass fiber may be added to the external resilient cement coating 234, for example between 0.5% to 3% of cement weight, for example 1%. A suitable amount of admixture may be added to the external resilient cement coating 234, for example between 0.5% to 3% of cement weight, for example 1%. A suitable amount of water may be added, for example between 1 and 8% by weight of wet components. In one example a precursor cement mix is made comprising 2300 grams of High early Portland cement, 1550 grams of acrylic emulsion, 230 grams of silica fume, 1-2% of cement weight superplasticizer, 1000 to 5000 grams of stucco sand, 1% of cement weight fiberglass fiber, 1% of cement weight Air Minus™, and 200 grams of water for workability.

Referring to FIGS. 12-15, the composite structural board 210 may be formed using a suitable method. In a first stage, a wood board core 230 may be encased with a mesh layer 232. In a second stage, an external resilient cement coating 234 may be molded around the wood board core 230 with mesh layer 232, to form a composite structural board 210. Before encasing the wood board core 230 within the external resilient cement coating 234, the wood board core may be formed by adhering plural wood beams 231 together using an adhesive. Before molding, a resilient cement pre-cursor slurry may be formed, for example as above, and used in a suitable manner. The resilient cement coating 234 may be molded around the wood board core 230 and internal mesh layer 232, for example by using a board mold 238. The mold 238 may define an internal cavity 240, for example having ends 242 (only one is shown for convenience), side walls 244, and a base 246. The mold 238 may be shaped to form a suitable shape of board, such as a rectangular box or strip as shown. The resilient cement pre-cursor slurry may be initially poured into the board mold 238 to only form a base layer 35 in the board mold 238 (FIG. 13). The mold 238 may be vibrated to remove excess air from the resilient cement coating 234, at this or any stage of the molding process. The wood board core 230 with mesh layer 232 may be inserted onto the base layer 35 in the board mold 238. Once the wood board core 230 and mesh layer 232 is correctly positioned in the mold, additional resilient cement pre-cursor slurry may be added to the mold 238 to immerse the sides and top of the wood board core 230 with mesh layer 232. An additional mesh layer 236 may be added to the mold 238 within the cement pre-cursor slurry, for example embedded adjacent a top face of the board. The structural board 210 may be cured or otherwise left to set, a suitable amount of time. In the example provided above, the board 210 may be left 24 hours to set before the boards 210 are removed from the mold 238. Mold-release compound may be used to line the internal cavity 240 of the mold 238 to facilitate release. The boards 210 may be left to set for longer periods of time, for example 7 days or more to complete setting and have maximum amount of the integrity and strength.

Figures 16, 17:
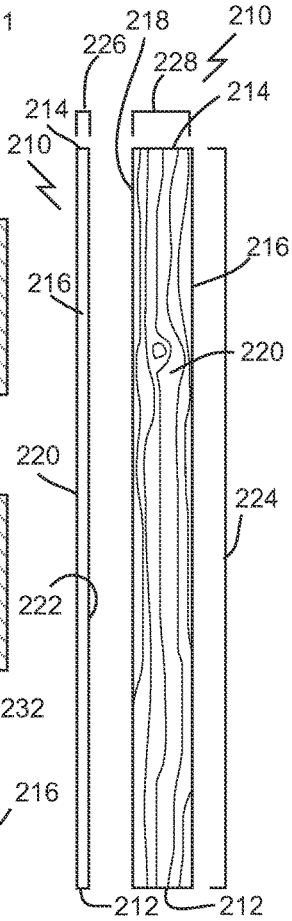
FIG. 16 is a side elevation view of the composite structural board of FIG. 1.
FIG. 17 is a top plan view of the composite structural board of FIG. 1.

Referring to FIGS. 11-17, the composite structural board 210 may be formed to have suitable dimensions and properties. The structural board 210 may be formed to define a set of ends 212 and 214, a top surface 220, a base surface 222, and a set of sides 216 and 218. The structural board 210 may be formed to comprise a suitable length 224, for example 96 inches in length. The structural board 210 may be structured with resiliency sufficient to elastically deform one inch or more per eight foot of length 224, for example by lifting an end 214 above a plane upon which base surface 222 of board 210 lies, with end 212 secured against lifting. The ability of the board 210 to elastically deform may allow for relatively easier installation and higher durability of the board 210. The structural board 210 may have a suitable width 228, for example 5½ inches. The structural board 210 may have a suitable height 226, for example 1⅛ inches. The cement coating 34 may act as the exterior portion of the structural board 210, and may be stamped or contoured to recreate the look of wood, for example as shown in FIG. 17. Scratches and scuffs of the resilient cement coating 34 are unlikely but may buffed out and patched. The structural boards 210 may be sealed and colored, or subject to other pre-treatments.

Figure 11:
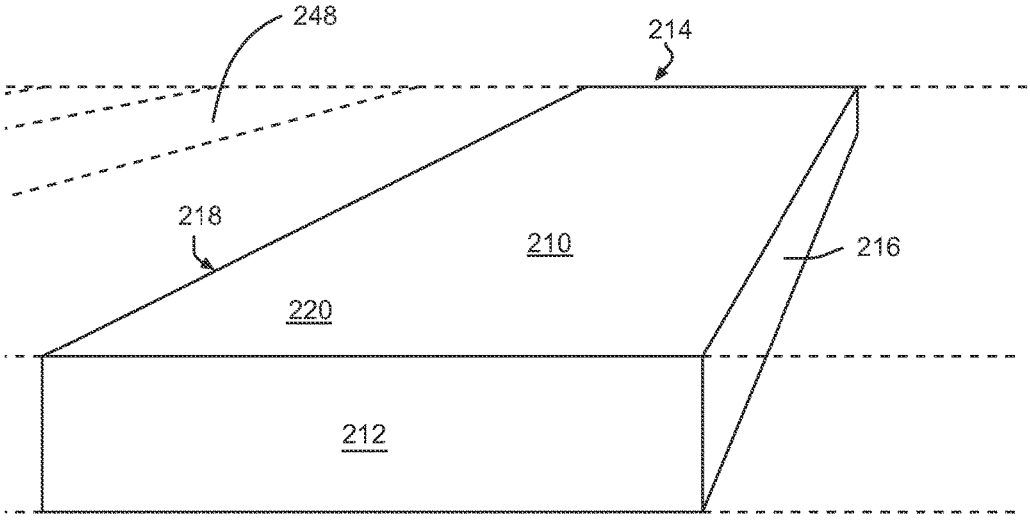
FIG. 11 is a perspective view of a composite structural board (solid lines) positioned as part of a deck (dashed lines).

Referring to FIG. 11, once the structural boards 210 have fully set, they can be installed in a deck 248, or other flooring, walkway, or roofing applications. The structural boards 210 may be screwed onto joists or substrate of a deck frame, either spaced or tight, in a fashion similar to the use of wood deck boards. The structural boards 210 may be connected to a deck frame or other substrate by using the adhesive compound for any applications that prohibit screwing through the substrate.

Driveway Stones

Driveways are commonly used as paths to private garages, carports, or houses. A driveway may refer to a small apron of pavement in front of a garage often sized and used to accommodate a car. A car may be parked on a driveway to leave the streets clear for traffic. A driveway may be made from one or more of concrete, decorative brick, cobblestone, block paving, asphalt, gravel, and decomposed granite. Asphalt paved driveways are very popular, providing a durable surface for parking of a vehicle. In general, asphalt has the cheapest installation costs, although it needs resealing, which will cost more over time. Properly installed asphalt paved driveways have a life expectancy of about thirty or more years. Poured concrete driveways are another popular driveway type, as they provide a permanent low-maintenance driveway. While poured concrete may cost more to install, when properly sealed, it is durable and requires less maintenance. While concrete is more resilient and may last longer, it will crack over time. Concrete driveways may be stamped or stained, which may add increased aesthetic components when compared to other types of driveways. Concrete driveways may last 30-40 years depending on if the concrete cracks. Paver stone driveways are the most expensive investment due to material and labor costs. Paver stone driveways are high durable and should last a lifetime. The longevity of a paver stone driveway is due to the driveway acting as flexible fabric. The driveway is not a rigid system and can move with the earth, preventing cracking. Paver stones offer valuable design flexibility and aesthetic impact as well. Paver stones come in a wide variety of materials including concrete, clay brick, cobblestone or natural stones. Paver stones can be laid in patterns and in some cases may shaped so they can interlock with other pavers of the same type. Paver stones may be are porous, which may cause them to become stained over the years and might require pressure washing to remove marks from oil, tires and other contaminants. The small spaces between interlocking stones may lead to a slightly uneven surface which may make shoveling snow difficult. Weeds and other plants may also grow between paver stones, which may require periodic spraying with herbicide.

Since paver stone driveways are not may of a continuous material, it is important that the paver stone driveways are built over a solid base to prevent pavers from shifting, which may cause cracks and gaps to appear. In order to create a solid foundation below the paver stone driveway, the ground must first be excavated. The ground should be excavated to a depth which allows the paver stones to be flush with the surrounding ground. Once the required depth has been reached, the ground may be compacted and leveled. Base material may be added on top of the ground, such as crushed rock, sand or gravel. Base material may be laid at a suitable thickness, for example between 4 and 8 inches. Once the base material has been laid it its compacted and leveled. In order to ensure a solid foundation, base material may be compacted several times throughout the process of laying it.

The top surface of a driveway may be finished in a variety of ways. An exposed aggregate finish creates a non-slip sealed surface that can last for nearly a decade with little or no maintenance. Exposed aggregate is created using special concrete mixes that combine unique aggregates that are exposed on the surface. Epoxy coating finish is a simple and cost-effective finish, and may make the driveway more attractive, durable, and safe. Epoxy finishes are easy to maintain, come in limitless finishes, and are incredibly durable. Typically, epoxy coatings can last up to 10 years. Epoxy comprises two chemicals, an epoxy resin and a polyamine hardener. The two chemicals are mixed and then applied to the driveway surface to seal it. Polyaspartic coatings are also used to finish driveways. Polyaspartic coatings are similar to epoxies, but polyaspartic coatings may cure faster, be UV resistant, resistant to chemicals and allow for heavier weights. Concrete and asphalt driveways may be sealed using a sealant to prolong their lifespan. Coal tar sealers are standard sealers have been used on asphalt driveways and streets for decades. They are made from coal tar, a sticky black substance derived from bituminous coal. Coal tar goes on as a black liquid and then forms a tough surface on asphalt known as a sealcoat. Coal tar sealers can effectively fill small cracks, seal, and recoat asphalt driveways with a protective coating that lasts up to 4 years. Coal tar sealers are not considered environmentally friendly, and the use of coal tar sealer has been banned in some areas. A driveway resurfaced with coal tar sealer may emit a tar-like odor for months. Though a coal tar sealer will become very hard and protective, it is not flexible once it cures; this means rather than expanding and contracting, it will likely crack. Asphalt-based sealers are composed mainly of asphalt cement and emit fewer toxic fumes than coal tar sealers, making them a popular choice for most homeowners. Asphalt-based sealers are designed to fill cracks and provide a smooth, hard surface that should last up to 6 years before requiring recoating. Asphalt-based sealers create a hard, durable surface, but expands and contracts slightly with temperature variations, does not crack as easily as coal tar sealers. Plain surface sealers are usually made of thick black liquid that is generally applied with a heavy-duty paint roller. Plain surface sealers are intended for use on a driveway that is in relatively good shape, with no potholes or sinkholes. Plain sealers do not contain sand, so they do not fill holes or cracks, which should be patched or filled before applying plain sealer. Plain surface sealers often contain fine silica powder that produces a textured, nonslip surface. A surface sealer offers an added layer of protection that can last up to 3 years. Fill-and-seal products contain sand, or sand-like ingredients, that fill cracks up to ⅛ inch wide when spread onto the existing driveway with a utility broom or driveway squeegee. Fill-and-seal products leave behind a textured, nonskid surface. Potholes and cracks wider than ⅛-inch should be filled with an asphalt patching product before applying a fill-and-seal product. DIY-friendly, and they are often available in low-VOC formulations. A coating will last up to 3 years on average.

Referring to FIG. 18, a floor system 310 is disclosed, for example forming a driveway 350. The floor system 310 comprises a stone panel layer 312 and a cement base layer 336. The cement base layer 336 may comprise a plasticizing layer 338. The plasticizing layer 338 may comprise a suitable material, such as a polymeric material, for example foam, plastic, or other expanded polymeric material, for example an expanded polystyrene (EPS) foam mesh board 342. The stone panel layer 312 may comprise a plurality of stone panels 314 laid side-by-side over the cement base layer 336. The floor system 310 may comprise an external overlayer 348 on top of the panels 314. The floor system 310 may be formed by laying the cement base layer 336 on a ground surface, adhering the stone panel layer 312 to the cement base layer 336, and applying the external overlayer 348 to the stone panel layer.

Referring to FIG. 18, the floor system 310 may be laid on top of a gravel underlayer 346. The gravel underlay may form a foundation, for example a compacted foundation, for the driveway stone system. The gravel underlayer 346 may be laid on top of the ground surface, which may be compacted before the laying of the gravel underlayer 346. The gravel underlayer 346 may support the cement base layer 336, for example, the gravel underlayer 346 may prevent sagging and cracking of the cement base layer 336. The gravel underlayer 346 may have a suitable thickness, for example between 4 to 8 inches deep, for example 6 inches deep, and in some cases larger or smaller depths.

Referring to FIGS. 18-20, the cement base layer 336 may have a suitable structure. The cement base layer 336 may comprise a lower layer 354 of cement. The cement base layer 336 may be embedded with one or more wire mesh layers, for example, the lower layer 354 of cement may be embedded with a wire mesh layer 344, for example fiberglass mesh. The plasticizing layer 338 may be laid on top of the wire mesh layer 344, for example on top of the lower layer 354 of cement. The plasticizing layer 338 may form a foam board 342 that is structured as a mesh to define a network of hollow column passages 340, such as vertical hollow column passages 340. Referring to FIG. 19, passages 340 may each define a polygonal cross-sectional profile, for example a honeycomb shape. The column passages 340 may be appropriately sized and spaced, for example the passages 340 may be 2 inches long, 2.5-3 inches wide and 2-3 inches spaced apart, although other dimensions larger or smaller may be used. The plasticizing layer 338 may comprise a suitable polymeric material, for example type 1 expanded polystyrene (EPS) insulation (foam board 342) defining the column passages 340 through which cement passes during formation of the layer 336 to secure the layer 338 in the cement. Forming the cement base layer 336 may further comprise laying an upper layer 352 of cement on top of the plasticizing layer 338. The upper layer 352 of cement may immerse the foam board 342 and impregnate the hollow column passages 340 with cement, securing the upper and lower layers 352 and 354 of cement together. The upper layer 352 of cement may thus connect to the lower layer 354 of cement through the hollow column passages 340. The upper layer 352 of cement may comprise a wire mesh layer 344. The plasticizing layer 338 may thus be disposed between a lower mesh layer 344 in the lower layer 354 of cement and an upper mesh layer 344 in the upper layer 352 of cement. The wire mesh layers 344 may move with the floor system 310 and allow microcracks while preventing major cracks in the floor system 310 and holding the cement base layer 336 together.

Referring to FIG. 18, the disclosed base layer 336 may be provided with resiliency as follows: 1) the Styrofoam™ between two layers 352, 354 (for example 1 inch deep each) concrete ties up the plasticizing layer 338 and allows slight flexible movement. This may be beneficial because standard concrete slabs are rigid and any movement (for example from shifting or uneven ground or load, will cause major cracks, while the disclosed system forms microcracks that are not detrimental to the driveway or flooring surface. Moreover, the honeycomb or other-shaped cylinders (columns/passages 340) in the Styrofoam™ allow the two layers 352, 354, of concrete, to be connected, which makes "table top" movement possible for the whole foundation system.

Referring to FIG. 18, the resilient cement base layer 336 may comprise a suitable composition. For example, the cement base layer 336 may be made with Portland cement and a plasticizer. A plasticizer may add resilient character to the cement. The plasticizer may be a suitable plasticizer, such as a super plasticizer, for example sulfonated naphthalene formaldehyde condensate, sulfonated melamine formaldehyde condensate, acetone formaldehyde condensate and polycarboxylate ethers. The resilient cement base layer 336 may be made with one or more of fly ash, silica fume, and sand. The silica fume may enhance mechanical and durability properties of concrete. The components of cement base layer 336 may be provided in suitable amounts. For example, the Portland cement may comprise high early Portland cement, and may be added in a suitable amount, for example between 5 and 15% by weight of wet components (wet cement weight). The superplasticizer may be added to the cement base layer in a suitable amount, for example between 0.5% and 4% of the wet cement weight. The fly ash may be type F fly ash, and may be added to the cement base layer in a suitable amount, for example between 0.5% and 25% of the wet cement weight. The silica fume may be added to the cement base layer 336 in a suitable amount, for example between 0.1% and 10% of the wet cement weight. The sand may be added to the cement base layer 336 in a suitable amount, for example between 60 and 95% of the wet cement weight. The cement base layer 336 may comprise a suitable amount of water, for example between 0.5 and 5% by wet cement weight. In one example, the wet cement precursor mix may be made by mixing 40 kilograms of high early Portland cement, 450 kilograms of concrete sand, 14 kilograms of water, 1-2% wet cement weight of superplasticizer, 0.5-5% wet cement weight of silica fume, and 1-15% wet cement weight of type-F fly ash.

Referring to FIG. 18, the stone panels 314 of the stone panel layer 312 may be laid on top of the cement base layer 336. The stone panel layer 312 may be secured to the cement base layer 336 by an adhesive 81. The driveway stones may be specifically made with materials that allow flexible movement with the entire foundation system to prevent any major cracks from happening. After the cement base layer 336 has set for a sufficient time, for example at least 24 hours, the adhesive 81 may be applied to the cement base layer 336. The adhesive may have a suitable composition, for example, the adhesive may comprise one or more of Portland cement, acrylic emulsion, and sand. Water may also be added. The components may be added in suitable amounts. The Portland cement may be added to the adhesive in a suitable amount, for example between 10 and 65% by wet adhesive weight. The acrylic emulsion may be added to the wet adhesive in a suitable amount, for example between 5 and 40% by wet adhesive weight. The sand may be added to the adhesive in a suitable amount, for example between 20 and 90% by wet adhesive weight. Water may be added to the adhesive in a suitable amount, for example between 0.1% and 3% of the wet adhesive weight. In one example, a suitable adhesive is made using 20 kilograms of Portland cement, 10 to 80 kilograms of silica sand or washed stucco sand, 5-10 kilograms of acrylic emulsion (diluted with water), and 0.5%-1% of wet adhesive weight of water for workability. The stone panels 314 may be adhered to the cement base layer 336 in any appropriate design, for example, the stone panels may be spaced apart by spacers, such as using ¼ to 1 inch or greater or smaller spacings for grout 334 to be thereafter added.

Referring to FIG. 18, the stone panels 314 of the stone panel layer 312 may have a suitable structure and composition. Each stone panel 314 may form a rectangular box, for example with ends 316 and 318, side walls 320 and 322, top surface 324 and bottom surface 326. Other shapes may be used, such as polygonal, rounded, triangular, or others, such as other shapes of paving stones seen in industry. Each stone panel 314 may have a suitable size, for example ¾ inch by 212 inch by 24 inch, although other sizes may be used. Each stone panel 314 may be made with Portland cement and a plasticizer. The Portland cement may comprise high early Portland cement and may be added to form the stone panels 314 in a suitable amount, for example between 20 and 50% by wet cement weight. The plasticizer may comprise a superplasticizer, and may be added to form the stone panels 314 in a suitable amount, for example between 0.5 and 4% of wet cement weight. Each stone panel 314 may be made with one or more of perlite, silica fume and sand. Perlite may act to create a lightweight concrete. Perlite may be added to the stone panels 314 in a suitable amount, for example between 1 and 10% by wet cement weight. The sand may comprise stucco sand, and may be added to the stone panels 314 in a suitable amount, for example between 15 and 60% by weight cement weight. In one example, a suitable precursor cement mix for forming stone panels 314 may be prepared using 40 kilograms of high early Portland cement, 20 kilograms of water. 3 kilograms of perlite, 1-2% wet cement weight of superplasticizer, and 20 to 50 kilograms of stucco sand. Wet cement precursor mix may be poured into a stone panel mold (not shown), and allowed to set or cure until hard enough to use in stone panel layer 312.

Referring to FIG. 18, each stone panel 314 may comprise one or more forms or reinforcement, such as rebar rods 328. The rebar rods 328 may act to reinforce the stone panels 314. The rebar rods 328 may be a suitable size, for example between ½ and ⅝ inches in diameter, or other suitable dimensions. The rebar rods 328 may comprise a suitable material, for example, basalt or fiberglass, and in some cases, metal. Each stone panel 314 may comprise one or more mesh reinforcing layers 330. The mesh reinforcing layer 330 may function to reinforce the stone panel 314 and comprise a suitable mesh, such as 6-ounce fiberglass mesh. The stone panel 314 may comprise upper and lower fiberglass mesh layers 330 (for example from mesh sheets) as the one or more reinforcing layers. Fiberglass or other reinforcing fibers may be distributed about the cement that makes up a stone panel 314.

Referring to FIG. 21, the stone panels 314 may be jointed, adhered together, and/or sealed by suitable methods. Once the adhesive 81 between the stone panels 314 and the cement base layer 336 has set for a sufficient time, for example a minimum of 24 hours, the stone panels 314 may be adhered together. The stone panels 314 may be adhered together via a grout. The grout may be applied between the stone panels 314 at a suitable thickness based on the gap spacing between adjacent tiles/panels 314, for example at a ¼ inch depth, if it is desired to use a backer rod (see below), or to level with the top surface 324 of the tile panels 314 if it is desired to fill the spacings with grout. The grout may have a suitable composition, for example, the grout may comprise an acrylic/styrene emulsion, type F fly ash, and silica sand. The acrylic/styrene emulsion may be added to the grout in a suitable amount, for example between 20 and 45% by wet grout weight. The type F fly ash may be added to the grout in a suitable amount, for example between 20 and 45% by wet grout weight. The silica sand may be added to the grout in a suitable amount, for example between 20 and 45% by wet grout weight. In one example, a suitable grout may be made by mixing 150 grams of acrylic/styrene emulsion, 150 grams of type F fly ash, and 150 grams of silica sand.

Referring to FIG. 21, once the grout 334 has been applied between the stone panels 314 to a sufficient depth, an appropriately sized backer rod 73 may be added on top of the grout layer 338. The backer rod 73 may be made of a suitable material, such as polyurethane foam. Backer rods are usually round, flexible lengths of foam that are used as a "backing" in joints or cracks to help control the amount of sealant/caulking used and create a back stop. Many sizes/diameters are available for optimal fitting to the size of the joint being sealed. The backer rod may function to allow the application of a parge to fill between the stone panels 314 to level the joint with the top surface 324 of the stone panel 314.

Referring to FIG. 21, once the backer rod 73 is set, a parge 75 may be applied to fill the gaps between adjacent panels 314 to level, flush with top surfaces 324. The parge 75 may have a suitable composition, for example the parge may comprise an acrylic/styrene emulsion, type f fly ash, and silica sand. The acrylic/styrene emulsion may be added in a suitable amount, for example between 10-40% by wet parge weight. The type F fly ash may be added in a suitable amount, for example between 20-40% by wet parge weight. The silica sand may be added in a suitable amount, for example between 20 and 70% by wet parge weight. In one example, a suitable parge precursor mixture is made by mixing 150 grams of acrylic/styrene emulsion, 100-150 grams of type F fly ash, and 150-450 grams of silica sand. The composition of the grout and the parge may allow for flexibility and movement between the stone panels 314.

Referring to FIG. 18, the stone panel layer 312 may be finished via a suitable method. The stones are coated with epoxy, aggregates and our own parge material. All these materials and combination allows flexibility and movement of the stones. Then the user grouts the joints with our own flexible material. One or more external over layer 348 may be applied to the stone panel layer 312. The external over layer 348 may be applied to the stone panel layer 312 after the stone panels 314 have set for a sufficient amount of time, for example a minimum of 72 hours, after they are formed. In some cases, epoxy may be applied to the top surface 324 of the stone panels 314, as the overlayer 348. Epoxy is the family of basic components or cured end products of epoxy resins. Epoxy resins, also known as polyepoxides, are a class of reactive prepolymers and polymers which contain epoxide groups. Reaction of polyepoxides with themselves or with polyfunctional hardeners forms a thermosetting polymer, often with favorable mechanical properties and high thermal and chemical resistance. Epoxy has a wide range of applications, including metal coatings, composites, use in electronics, electrical components (e.g., for chips on board), light-emitting diodes (LEDs), high-tension electrical insulators, paint brush manufacturing, fiber-reinforced plastic materials, and adhesives for structural and other purposes. Aggregate, such as pebble stones 332, may be added to the epoxy, for example in such a way that allows the aggregate to be exposed. The aggregate may be added before the epoxy has set, or in some cases, an adhesive may be applied first to the panels 314 instead of epoxy, aggregate added, and thereafter epoxy is added to the stones. Stones 332 may be sized to provide traction to the top surface 324 of the stone panels 314, and may be a suitable size, such as between ½ and ⅝ inches diameter, although other sizes may be used. After the epoxy is set (for example 18-24 hours at room temperature), for example applied to the rough top surfaces 324 of the panels 314, the epoxy may be parged with parge mix. After the parge mix has set (for example 24 hours or more), a solvent or water-based sealer may be applied to the top surface 324 of the stone panels 314. After the water-based sealer has set (for example 24 hours or more), a polyurethane sealer may be applied to the top surface 324 of the stone panel 314, and thereafter allowed to set.

Referring to FIGS. 18-20 the stone panels 314 may address the challenges and downfalls of traditional concrete slab driveways, such as inevitable cracks due to shrinkage, freeze and thaw heaving. The stone panels 314 may be relatively durable, flexible, economical, versatile, aesthetic, efficient to manufacture and easy to apply and work with compared to traditional concrete slab driveways. The composition of the stone panels 314 may allow some resiliency, for example up to ½ inch deflection on either side of a panel 314. The composition of the grout may also allow for increased flexibility. The flexibility of the stone panels 314, grout and cement base layer 336 may produce a long-lasting driveway 350 which is not prone to forming major cracks, and that is relatively easy to install. The driveway 350 may be installed to define a suitable slope, for example 0.5%, slope to the outer edges, which may allow proper drainage of water.

References to upper, lower, top, base, and other directional terms are understood to be relative terms, that refer to the parts in assembled form on a ground surface. Although the flooring and road systems disclosed herein are disclosed in horizontal application examples, for example covering a level horizontal ground surface, or located on a deck frame that is level, in other cases the systems may be applied to non-level or non-horizontal substrates, such as vertical, angled, or uneven substrates. Examples compositions given in amounts are understood to refer to relative proportions, and other components may be added as needed.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A structural system comprising:

a plurality of blocks arranged in rows stacked on each other, with the blocks of each row staggered relative to the blocks of adjacent said rows, each block having an insulative foam core, and external coating plates cladding opposed inside and outside faces of the block between opposed side ends of the block; and a plurality of cement columns extended through the adjacent rows of the plurality of blocks via aligned columnar apertures defined within the insulative foam core of each block, in which, for each block:

the opposed side ends of the block are structured to abut corresponding side ends of the opposed side ends of adjacent blocks of the plurality of blocks with the insulative foam cores of the opposed side ends of the block and the corresponding side ends of the adjacent blocks being in unbroken contact with one another from the inside face to the outside face of the block; and all of the columnar apertures of the block are defined within the insulative foam core, spaced at regular intervals from one another, and spaced from the inside face, the outside face, and the opposed side ends, of the block.

2. The structural system of claim 1 further comprising a plurality of structural beams extended through or between the rows of the plurality of blocks.

3. The structural system of claim 2 in which:

the plurality of structural beams are extended at an interface between the adjacent rows of the blocks via aligned beam slots defined within one or both of top and bottom faces of the blocks; and the aligned beam slots are defined within both of top and bottom faces of the blocks.

4. The structural system of claim 3 in which the aligned beam slots communicate with the aligned columnar apertures such that the plurality of cement columns and the plurality of structural beams integrally connect to form a structural matrix.

5. The structural system of claim 2 in which the plurality of structural beams comprise rebar.

6. The structural system of claim 1 in which the plurality of cement columns comprise rebar.

7. The structural system of claim 6 in which:

the structural system forms a wall; and the rebar of the plurality of cement columns secures to one or both a roof and floor above and below the wall, respectively.

8. The structural system of claim 1 in which each insulative foam core comprises expanded polystyrene.

9. The structural system of claim 1 in which the external coating plates comprise Sorel cement.

10. The structural system of claim 9 in which the external coating plates comprise:

magnesium chloride and magnesium oxide;

fly ash;

sand; and perlite.

11. The structural system of claim 1 in which the external coating plates are secured to the blocks via an adhesive.

12. The structural system of claim 11 in which the adhesive comprises Sorel cement.

13. The structural system of claim 1 in which the external coating plates are embedded with one or more of rebar columns and reinforcing mesh.

14. The structural system of claim 1 in which the cement columns comprise Sorel cement.

15. The structural system of claim 14 in which the cement columns comprise:

magnesium chloride and magnesium oxide;

fly ash;

silica fume;

reinforcing fibers; and sand; and are made with acrylic emulsion.

16. A method comprising:

arranging a plurality of blocks in rows stacked on each other, with the blocks of each row staggered relative to the blocks of adjacent said rows, each block having an insulative foam core, and external coating plates cladding opposed inside and outside faces of the block between opposed side ends of the block; and pouring cement through the adjacent rows of the plurality of blocks via aligned columnar apertures defined within the insulative foam core of each block, in which, for each block:

the opposed side ends of the block abut corresponding side ends of the opposed side ends of adjacent blocks of the plurality of blocks with the insulative foam cores of the opposed side ends and of the block and the corresponding side ends of the adjacent blocks in unbroken contact with one another from the inside face to the outside face of the block; and all of the columnar apertures of the block are defined within the insulative foam core, spaced at regular intervals from one another, and spaced from the inside face, the outside face, and the opposed side ends, of the block.

17. The method of claim 16 further comprising:

laying rebar beams through or between rows of the plurality of blocks; and before pouring, extending rebar through the adjacent rows of the plurality of blocks via the aligned columnar apertures.

18. The method of claim 17:

in which the plurality of blocks form a wall; and further comprising securing the rebar of the plurality of cement columns to one or both a roof and floor above and below the wall, respectively.

19. The method of claim 16 further comprising:

forming each block by adhering the external coating plates to the insulative foam core; and forming each insulative foam core by one or more of cutting and molding the insulative foam core.

20. A structural block comprising:

an insulative foam core;

external coating plates cladding opposed inside and outside faces of the structural block between opposed side ends of the structural block;

a series of columnar apertures, extended between and arranged in regular intervals along, top and bottom faces of the structural block, such that the columnar apertures align in use with corresponding columnar apertures of other respective structural blocks that are identical with the structural block when such other respective structural blocks are laid above and below the structural block in staggered conformation, with the opposed side ends of the structural block structured to abut the side ends of the other respective structural blocks with the insulative foam cores of the opposed side ends and side ends being in unbroken contact with one another from the inside face to the outside face of the structural block, and all of the columnar apertures of the structural block being defined within the insulative foam core, spaced at regular intervals from one another, and spaced from the inside face, the outside face, and the opposed side ends, of the structural block.

* * * * *